US009293145B2

(12) United States Patent
Virette et al.

(10) Patent No.: US 9,293,145 B2
(45) Date of Patent: Mar. 22, 2016

(54) DEVICE AND METHOD FOR POSTPROCESSING A DECODED MULTI-CHANNEL AUDIO SIGNAL OR A DECODED STEREO SIGNAL

(71) Applicant: Huawei Technologies Co., Ltd., Shenzhen (CN)

(72) Inventors: David Virette, Munich (DE); Yue Lang, Munich (DE); Lei Miao, Beijing (CN); Wenhai Wu, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 413 days.

(21) Appl. No.: 13/850,655

(22) Filed: Mar. 26, 2013

(65) Prior Publication Data

US 2013/0236022 A1 Sep. 12, 2013

Related U.S. Application Data

(63) Continuation of application No. PCT/CN2010/077385, filed on Sep. 28, 2010.

(51) Int. Cl.
*G10L 19/00* (2013.01)
*G10L 19/008* (2013.01)
(Continued)

(52) U.S. Cl.
CPC ..... *G10L 19/008* (2013.01); *G10L 21/0364* (2013.01); *G10L 19/025* (2013.01)

(58) Field of Classification Search
CPC ..... G10L 19/00; G10L 19/008
See application file for complete search history.

(56) References Cited

U.S. PATENT DOCUMENTS 5,109,417 A * 4/1992 Fielder et al. ..... 704/205
5,451,954 A * 9/1995 Davis et al. ..... 341/200
(Continued)

FOREIGN PATENT DOCUMENTS

CN 1985544 A 6/2007
CN 101460997 A 6/2009
(Continued)

OTHER PUBLICATIONS

Schuijers et al., "Advances in Parametric Coding for High-Quality Audio" Audio Engineering Society, Convention Paper 5852, Presented at the 114th Convention, Mar. 22-25, 2003.
(Continued)

*Primary Examiner* — Daniel Abebe
(74) *Attorney, Agent, or Firm* — Brinks Gilson & Lione

(57) ABSTRACT

According to the invention, a device (101, 101') for postprocessing at least one channel signal of a plurality of channel signals of a multi-channel signal is described, the at least one channel signal being generated from a decoded downmix signal by a low-bit-rate audio coding/decoding system, the device comprising: a receiver (103; 103') for receiving the at least one channel signal generated from the decoded downmix signal, a time envelope of the decoded downmix signal and a classification indication indicating a transient type of the at least one channel signal, wherein the classification indication is associated to the at least one channel signal, and a postprocessor (105; 105') for postprocessing the at least one channel signal based on the time envelope of the decoded downmix signal weighted by a respective weighting factor and in dependence on the classification indication.

12 Claims, 13 Drawing Sheets

(51) Int. Cl.
*G10L 21/0364* (2013.01)
*G10L 19/025* (2013.01)

(56) References Cited

U.S. PATENT DOCUMENTS

| | | | | |
|---|---|---|---|---|
| 2009/0164221 | A1* | 6/2009 | Kim et al. | 704/500 |
| 2009/0164222 | A1* | 6/2009 | Kim et al. | 704/500 |
| 2009/0319282 | A1 | 12/2009 | Allamanche et al. | |
| 2010/0023335 | A1 | 1/2010 | Szczerba et al. | |
| 2010/0076774 | A1 | 3/2010 | Breebaart | |
| 2011/0058679 | A1 | 3/2011 | Van Loon et al. | |
| 2011/0091046 | A1 | 4/2011 | Villemoes | |

FOREIGN PATENT DOCUMENTS

| | | | |
|---|---|---|---|
| CN | 101578658 | A | 11/2009 |
| WO | WO 02/093560 | A1 | 11/2002 |

OTHER PUBLICATIONS

Crockett et al. "Improved Transient Pre-Noise Performance of Low Bit Rate Audio Coders Using Time Scaling Synthesis" Audio Engineering Society, Convention Paper 6184, Oct. 28-31, 2004.

International Search Report and Written Opinion of the International Searching Authority issued in corresponding PCT Patent Application No. PCT/CN2010/077385, mailed Jun. 30, 2011.

* cited by examiner

DEVICE AND METHOD FOR POSTPROCESSING A DECODED MULTI-CHANNEL AUDIO SIGNAL OR A DECODED STEREO SIGNAL

CROSS-REFERENCE TO RELATED APPLICATIONS

This application is a continuation of International Application No. PCT/CN2010/077385, filed on Sep. 28, 2010, which is hereby incorporated by reference in its entirety.

BACKGROUND OF THE INVENTION

The present invention relates to postprocessing a decoded multi-channel audio signal and to postprocessing a decoded stereo audio signal, the postprocessing of the decoded stereo audio signal representing a specific case of postprocessing a decoded multi-channel audio signal.

In a conventional speech codec, classification of the speech signals is often performed to improve the coding efficiency of the speech signals. At the decoder side, different types of signal processing tools are used depending on the transmitted classification of the speech signals.

One classification is to distinguish between normal speech signals and transient speech signals. Transient signals are short duration signals and are characterized by a fast change in signal power and amplitude. The transient signals are, e.g., distinguished from "normal" or non-transient signals, e.g. signals with a longer duration and/or only minor changes in signal power and amplitude. This kind of classification is not limited to speech signals but is applicable to audio signals in general.

For transient signals, a common method is to extract the time envelope of the input signal in the encoder, transmit it and apply it in the decoder as a postprocessing.

For stereo signals, such a kind of postprocessing is often necessary, but there are conventionally not enough bits to encode the time envelope of both channels.

Referring to reference [1], low-bit-rate stereo coding is based on the extraction and quantization of a parametric representation of the stereo image. The parameters are then transmitted as side information together with a mono downmix signal encoded by a core coder. At the decoder, the stereo signal can be reconstructed based on the mono downmix signal and the side information, i.e. the stereo parameters containing the spatial (left and right) information of the stereo signal.

For a stereo codec, if the downmix mono signal is classified as transient, there may be pre-echo artefacts in the reconstructed stereo signal. Postprocessing may be done to improve the quality of this type of signal whose both channels are transient or only one channel is transient. But for a parametric stereo codec, there are conventionally not enough bits to encode the time envelope of both channels.

According to references [2] and [3], the input mono signal is classified into transient and normal categories in the encoder. Then, at the decoder side, based on the transmitted classification information, a time scaling synthesis algorithm is used to improve the quality. All those kinds of algorithms are applied to the mono downmix signal.

The limitation of the bandwidth available for transmitting signals is not only encountered for the transmission of stereo speech or audio signals but forms a general problem for multi-channel audio signal transmission, the stereo audio coding representing a specific case of multi-channel audio coding.

SUMMARY OF THE INVENTION

A goal to be achieved by the present invention is to provide an improved low-bit-rate parametric multi-channel or parametric stereo coding method, which allows to reduce pre-echo artefacts in case of transient audio signals in an bandwidth efficient manner.

According to a first aspect, a device for postprocessing a decoded stereo signal processed by a low-bit-rate audio coding system is suggested, wherein the device has a receiver and a postprocessor. The device is for postprocessing at least one of a left and a right channel signals of the stereo signal, the left and right channel signals being generated from a decoded downmix signal by a low-bit-rate audio coding/decoding system, the downmix signal or decoded downmix signal representing the stereo signal. The receiver is configured to receive a left channel signal and a right channel signal of the stereo signal, the left channel signal and a right channel signal being generated from the decoded downmix signal, a time envelope of the decoded downmix signal and a classification indication indicating a transient type of the stereo signal. The postprocessor is configured to postprocess at least one of the left and right channel signals based on the time envelope of the decoded downmix signal weighted by a respective weighting factor and in dependence on the classification indication.

In dependence on the classification indication, it may optionally be decided which one or ones of the left and right channel signals are postprocessed. The postprocessing may optionally be done by means of the weighted time envelope of the decoded downmix signal which may be weighted by a weighting factor.

The downmix signal, which may be also called mono downmix signal or mono signal in case of stereo audio coding, may optionally be generated from the left and the right channel signals at the encoder side. The generated encoded downmix signal may optionally be transferred over an audio channel, or in general over a transmission link, to the device for postprocessing. Said device for postprocessing may optionally be part of a decoder. Further, there may optionally be a transient detection model or entity in the encoder for providing an indication to the device for postprocessing indicating if the downmix signal is transient or not. In particular, if the downmix signal is classified as transient by the transient detection model, the time envelope of the downmix signal may optionally be extracted and transmitted to the decoder which may include said device for postprocessing.

According to a first implementation form of the first aspect, the device may further have a decider for deciding which one or ones of the left and right channel signals are postprocessed. The decider may be configured to decide in dependence on the classification indication indicating a transient type of the stereo signal.

According to a second implementation form of the first aspect, the device may further have a decider for deciding which one or ones of the left and right channel signals are postprocessed, said decider may be configured to decide in dependence on the classification indication indicating a transient type of the stereo signal and on a further classification indication indicating a transient type of the decoded downmix signal. The classification indication indicating a transient type of the stereo signal and the classification indicating a transient type of the downmix signal may be provided by the encoder.

Additionally to the classification indication and to the further classification indication, the decider may optionally receive and use a channel level difference (CLD) and other stereo parameters. The CLD and the other stereo parameters may be provided by the encoder.

According to a third implementation form of the first aspect, the device may further have a decider for deciding which one or ones of the left and right channel signals are postprocessed, said decider being configured to decide in dependence on the classification indication indicating a transient type of the stereo signal, wherein the decider may be configured to decide that the right and the left channel signals are postprocessed, if the classification indication indicates a non-transient type of the stereo signal.

Thus, if the downmix signal is of the transient type and the stereo signal is of the non-transient type, both the right and the left channel signals can be postprocessed. For postprocessing the right and the left channel signals, the time envelope of the decoded downmix signal—also called mono time envelope—may be used differently weighted by different weighting factors, the weighting factors for the different channel signals being also referred to as channel signal specific weighting factors.

According to a fourth implementation form of the first aspect, the device may further have a decider for deciding which one or ones of the left and right channel signals are postprocessed, said decider may be configured to decide in dependence on the classification indication indicating a transient type of the stereo signal, wherein the decider may be configured to decide that one, e.g. only one, of the left and the right channel signals is to be processed, if the classification indication indicates a transient type of the stereo signal.

According to a fifth implementation form of the first aspect, the device may further have a decider for deciding which one or ones of the left and right channel signals are postprocessed, said decider may be configured to decide in dependence on the classification indication indicating a transient type of the stereo signal, wherein the decider may be configured to decide that the one of the left and the right channel signals having the higher signal energy is to be postprocessed, if the classification indication indicates a transient type of the stereo signal.

According to a sixth implementation form of the first aspect, the postprocessor may further have a first postprocessing entity for postprocessing the left channel signal using the received time envelope of the decoded downmix signal weighted by a first weighting factor.

According to a seventh implementation form of the first aspect, the postprocessor may further have a second postprocessing entity for postprocessing the right channel signal using the received time envelope of the decoded downmix signal weighted by a second weighting factor.

According to an eighth implementation form of the first aspect, the device may further have a decider, a first postprocessing entity and a second postprocessing entity. The decider may be configured to decide which one or ones of the left and right channel signals are postprocessed, said decider may be configured to decide in dependence on the classification indication. The first processing entity may be configured to postprocess the left channel signal using the received time envelope of the decoded downmix signal weighted by a first weighting factor. The second postprocessing entity may be configured to postprocess the right channel signal using the received time envelope of the decoded downmix signal weighted by a second weighting factor. The decider may be configured to control the first postprocessing entity and the second postprocessing entity.

According to a ninth implementation form of the first aspect, the device may further have a decider, a first postprocessing entity and a second postprocessing entity. The decider may be configured to decide which one or ones of the left and right channel signals are postprocessed, said decider may be configured to decide in dependence on the classification indication. The first processing entity may be configured to postprocess the left channel signal using the received time envelope of the decoded downmix signal weighted by a first weighting factor. The second postprocessing entity may be configured to postprocess the right channel signal using the received time envelope of the decoded downmix signal weighted by a second weighting factor. The decider may be configured to calculate the first weighting factor and the second weighting factor in dependence on a received channel level difference (CLD) of the left and the right channel of the stereo signal or based on other parameters or information received. The CLD or the other parameters or information may be provided by the encoder. These other parameters may, e.g., other energy metrics associated to the left and right channel signal, i.e. other than the CLD, or may even be the channel specific weighting factors.

According to a tenth implementation form of the first aspect, the device may further have a decider, a first postprocessing entity and a second postprocessing entity. The decider may be configured to decide which one or ones of the left and right channel signals are postprocessed, said decider may be configured to decide in dependence on the classification indication. The first processing entity may be configured to postprocess the left channel signal using the received time envelope of the decoded downmix signal weighted by a first weighting factor. The second postprocessing entity may be configured to postprocess the right channel signal using the received time envelope of the decoded downmix signal weighted by a second weighting factor. The decider may be configured to calculate the first weighting factor $a_{left}$ by $$a_{left} = \frac{2c}{1+c}$$

and the second weighting factor $a_{right}$ by $$a_{right} = \frac{2}{1+c},$$

wherein $$c = 10^{\frac{cld}{20}},$$

$$cld = \frac{1}{N}\sum_{b=0}^{b=N} CLD[b], \text{ and}$$

$$CLD[b] = 10\log_{10}\frac{\sum_{k=k_b}^{k_{b+1}-1} X_1[k]X_1^*[k]}{\sum_{k=k_b}^{k_{b+1}-1} X_2[k]X_2^*[k]}.$$

In detail, the channel level differences (CLDs) may optionally be extracted from the left and the right channel signal at the encoder side by using the following equation:

$$CLD[b] = 10\log_{10}\frac{\sum_{k=k_b}^{k_{b+1}-1} X_1[k]X_1^*[k]}{\sum_{k=k_b}^{k_{b+1}-1} X_2[k]X_2^*[k]} \quad (1)$$

where k is the index of frequency bin, b is the index of frequency band, $k_b$ is the start bin of band b, and $X_1$ and $X_2$ are the spectrums of the left and the right channels, respectively.

Further, the stereo classification indication may optionally be generated based on CLD monitoring at the encoder side. If a fast change of CLD between two consecutive frames is detected, the stereo signal may be classified as stereo transient.

Moreover, if the decoded CLD according to equation (1) is greater than 0, the energy of the left channel is higher than the energy of right channel. The weighting factor applied to the mono time envelope at the decoder side by the device may be calculated in the following way based on the CLD received from the encoder. The first step may be to calculate the average of CLD $$cld = \frac{1}{N}\sum_{b=0}^{b=N} CLD[b] \quad (2)$$

The second step may be to calculate c $$c = 10^{\frac{cld}{20}} \quad (3)$$

The last step may be to calculate the weighting factor $a_{left}$ of the left channel signal and the weighting factor $a_{right}$ of the right channel signal:

$$a_{left} = \frac{2c}{1+c} \quad (4)$$

and $$a_{right} = \frac{2}{1+c} \quad (5)$$

Before applying the time envelope coming from the mono decoding process to the left and right channels, the time envelope may optionally be multiplied by the corresponding calculated weighting factors.

According to a eleventh implementation form of the first aspect, the postprocessor may be configured to postprocess the right and the left channel signals using a respective weighted time envelope of the decoded downmix signal, if the classification indication indicates a non-transient type of the stereo signal.

According to a twelfth implementation form of the first aspect, the classification indication indicates that the stereo signal is stereo transient in case a change over time of a relation between an energy of the right channel signal and an energy of the left channel signal of the stereo signal exceeds a predetermined threshold.

According to a thirteenth implementation form of the first aspect, the classification indication indicates that a stereo signal is stereo transient in case a change over time of a channel level difference (CLD) determined between the right channel signal and the left channel signal of the stereo signal exceeds a predetermined threshold.

According to a fourteenth implementation form of the first aspect, the further classification indicates that the downmix signal is downmix transient in case a change over time of an energy of the downmix signal exceeds a predetermined threshold. If the downmix signal is a mono downmix signal, the downmix signal can also be referred to as being mono transient in case a change over time of an energy of the downmix signal exceeds a predetermined threshold.

Any implementation form of the first aspect may be combined with any other implementation form of the first aspect to obtain another implementation form of the first aspect.

According to a second aspect, a decoder for decoding a downmix signal processed from a stereo signal by a low-bit-rate audio coding system is suggested, the decoder having a mono decoder for decoding the downmix signal received over an audio channel, and an above described device for postprocessing the decoded downmix signal, if the stereo signal is transient or if the downmix signal and the stereo signal are transient.

According to a first implementation form of the second aspect, the decoder may have an upmixer for generating a left and a right channel signal in dependence on the downmix signal and spatial audio parameters associated to the downmix signal.

The decoder may optionally be any decoding means. Furthermore, the postprocessor may be any postprocessing means. Moreover, the upmixer may be any upmixing means.

The respective means, in particular the decoder, the receiver, the postprocessor and the upmixer, can be implemented in hardware or in software. If said means are implemented in hardware, it may be embodied as a device, e.g. as a computer or as a processor or as a part of a system, e.g. a computer system. If said means are implemented in software it may be embodied as a computer program product, as a function, as a routine, as a program code or as an executable object.

According to a third aspect, a method for postprocessing a decoded stereo signal processed by a low-bit-rate audio coding system is suggested. The method is for postprocessing at least one of the left and right channel signals of the stereo signal, the left and right channel signals being generated from a decoded downmix signal by a low-bit-rate audio coding/decoding system. The method has a step of receiving a left channel signal and a right channel signal of the stereo signal, the left channel signal and the right channel signal being generated from the decoded downmix signal, a time envelope of the decoded downmix signal and a classification indication indicating a transient type of the stereo signal, and a step of postprocessing at least one of the left and right channel signals based on the time envelope of the decoded downmix signal weighted by a respective weighting factor and in dependence on the classification indication.

According to a fourth aspect, a device for postprocessing at least one channel signal of a plurality of channel signals of a multi-channel signal is provided, the at least one channel signal being generated from a decoded downmix signal by a low-bit-rate audio coding/decoding system. The device comprises a receiver and a postprocessor. The receiver is adapted to receive the at least one channel signal generated from the decoded downmix signal, a time envelope of the decoded downmix signal and a classification indication indicating a transient type of the at least one channel signal, wherein the classification indication is associated to the at least one channel signal. The postprocessor is adapted to postprocess the at least one channel signal based on the time envelope of the decoded downmix signal weighted by a respective weighting factor and in dependence on the classification indication.

A multi-channel signal with more than two channel signals can be downmixed such that the multi-channel signal is represented by only one single downmix signal and a corresponding set of spatial audio parameters to be able to reconstruct the more than 2 channel signals from the single downmix signal. This single downmix signal is also referred to as mono downmix signal. In other words, for a mono downmix a multi-channel signal with, e.g., five channel signals, e.g. a front channel signal, a left channel signal, a right channel signal, a left rear channel signal and right rear channel signal, is downmixed to one single mono downmix signal. The downmix of a stereo signal to one single downmix signal is a specific case of the mono downmix of a multi-channel signal.

However, a multi-channel signal with more than two channel signals, i.e. M>=2, can be downmixed such that the multi-channel signal is represented by two or more downmix signals (but typically less than M) and corresponding sets of spatial audio parameters to be able to reconstruct the more than 2 channel signals from the more than two downmix signals. Each downmix signal is derived from at least two of the more than two channel signals of the multi-channel signal. In case channel signals from the left side and central signals (e.g. a front channel signal arranged in the center between the left and right side) are used to obtain a first downmix signal and channel signals from the right side and central signals are used to obtain a second downmix signal, both downmix signals are also referred to as stereo downmix signals, i.e. the left and right stereo downmix signal. In other words, for a stereo downmix, a multi-channel signal with, e.g., five channel signals, e.g. a front channel signal, a left channel signal, a right channel signal, a left rear channel signal and right rear channel signal, is downmixed to a left stereo downmix signal and to a right stereo downmix signal. The downmix to more than one downmix signal is not limited to stereo downmix signals and can comprise any number of downmix signals resulting from any combination of multi-channel signals of the multi-channel signal. The corresponding downmix signals may, therefore, also be referred to as first, second, etc. downmix channel signal, which form in their entirety the overall downmix signal.

According to a first implementation form of the fourth aspect, the device is for use in a parametric multi-channel audio decoder.

According to a second implementation form of the fourth aspect, the plurality of multi-channel signals are generated from a decoded and upmixed version of the downmix signal using parametric side-information associated to the downmix signal.

According to a third implementation form of the fourth aspect, the device further comprises a decider for deciding which one or ones of the plurality of channel signals are postprocessed, wherein the decider is configured to decide dependent on a classification indication indicating the transient type of the respective channel signal.

According to a fourth implementation form of the fourth aspect, the decider is configured to receive for each of the plurality of channel signals, or at least for each of a subset of the plurality of channel signals, a classification indication associated to the respective channel signal. Therefore, this kind of classification indication can also be referred to as channel specific classification indication.

According to a fifth implementation form of the fourth aspect, the classification indicates that a channel is channel transient in case a change over time of a relation of an energy of the channel signal and an energy of a reference signal exceeds a predetermined threshold.

According to a sixth implementation form of the fourth aspect, the classification indicates that a channel is channel transient in case a change over time of a channel level difference (CLD) determined for the respective channel signal and a reference signal exceeds a predetermined threshold.

According to a seventh implementation form of the fourth aspect, the reference signal used for determining the channel classification indication and/or the CLD is the downmix signal, one of the plurality of channel signals or a signal derived from at least one of the channel signals.

As the classification indication of the channel signal, the classification indication of the downmix signal and the other coding parameters, e.g. CLD, are determined at the encoder side to define the temporal and spatial characteristics of the multi-channel signal and to reconstruct the individual channel signals of the multi-channel signal at the decoder from the mono downmix signal, the classification indication of the channel signal, the classification indication of the downmix signal and the other coding parameters do not only specify the characteristics of the original channel signals (prior to encoding) and their relation among each other, but equally the respective characteristics of the reconstructed channel signals (after decoding) and their relation among each other.

According to an eighth implementation form of the fourth aspect, the decider is adapted to receive for each of the plurality of channel signals a channel specific channel level difference $CLD_m$ associated to the respective channel signal.

According to a ninth implementation form of the fourth aspect, the device comprises a decider for deciding which one or ones of the plurality of channel signals are postprocessed, the decider being configured to decide, whether a channel is postprocessed, dependent on the classification indication indicating the transient type of the channel signal and on a further classification indication indicating a transient type of the downmix signal.

According to a tenth implementation form of the fourth aspect, the further classification indicates that the downmix signal is downmix transient in case a change over time of an energy of the downmix signal exceeds a predetermined threshold.

According to an eleventh implementation form of the fourth aspect, the decider is configured to decide to postprocess none of the channel signals in case the further classification indication indicates that the downmix signal is not downmix transient.

According to a twelfth implementation form of the fourth aspect, the decider is configured to control the postprocessor to postprocess the at least one channel signal in case the further classification indication indicates that the downmix signal is downmix transient and the channel specific classification indication associated to the at least one multi-channel signal indicates that the at least one channel is not channel transient.

According to a thirteenth implementation form of the fourth aspect, the decider is configured to control the postprocessor to postprocess the at least one channel signal in case the further classification indication indicates that the downmix signal is downmix transient, the channel specific classification indication associated to the at least one multi-channel signal indicates that the at least one channel signal is channel transient, and an energy metric or other indicator of the at least one channel signal is greater than a corresponding energy metric or other indicator of a reference signal.

According to a fourteenth implementation form of the fourth aspect, the decider is configured to control the postprocessor to postprocess the at least one channel signal in case the further classification indication indicates that the downmix signal is downmix transient, the channel specific classification indication associated to the at least one multi-channel signal indicates that the at least one channel signal is channel transient, and a channel specific channel level difference $CLD_m$ between a reference signal and the at least one channel signal is smaller than a predetermined threshold.

According to a fifteenth implementation form of the fourth aspect, the decider is configured to control the postprocessor to postprocess the at least one channel signal in case the further classification indication indicates that the downmix signal is downmix transient, the channel specific classification indication associated to the at least one multi-channel signal indicates that the at least one channel signal is channel transient, and a channel specific channel level difference $CLD_m$ between the at least one channel signal and a reference signal is greater than a predetermined threshold.

According to a sixteenth implementation form of the fourth aspect, the decider is configured to control the postprocessor to not postprocess the at least one channel signal in case the further classification indication indicates that the downmix signal is downmix transient, the channel specific classification indication associated to the at least one multi-channel signal indicates that the at least one channel signal is channel transient, and an energy metric of the at least one channel signal is lower than a corresponding energy metric of a reference signal.

According to a seventeenth implementation form of the fourth aspect, the decider is configured to control the postprocessor to not postprocess (using the weighted time envelope) the at least one channel signal in case the further classification indication indicates that the downmix signal is downmix transient, the channel specific classification indication associated to the at least one multi-channel signal indicates that the at least one channel signal is channel transient, and a channel specific channel level difference $CLD_m$ between a reference signal and the at least one channel signal is greater than a predetermined threshold.

According to an eighteenth implementation form of the fourth aspect, the decider is configured to control the postprocessor to not postprocess (using the weighted time envelope) the at least one channel signal in case the further classification indication indicates that the downmix signal is downmix transient, the channel specific classification indication associated to the at least one multi-channel signal indicates that the at least one channel signal is channel transient, and a channel specific channel level difference $CLD_m$ between the at least one channel signal and a reference signal smaller than a predetermined threshold.

According to a nineteenth implementation form of the fourth aspect, the decider is configured to determine the channel specific weighting factor, with which the time envelope of the downmix signal is to be weighted with for the postprocessing of the at least one channel signal, dependent on a received channel level difference $CLD_m$ between the at least one channel signal m and a reference signal.

According to an twentieth implementation form of the fourth embodiment, the decider is configured to determine the channel specific weighting factor $a_m$ $$a_m = \frac{2}{1+c},$$

wherein c is determined by $$c = 10^{\frac{acld_m}{20}},$$

wherein $acld_m$ is determined by $$acld_m = \frac{1}{N}\sum_{b=0}^{b=N} CLD_m[b],$$

wherein $CLD_m[b]$ is determined by $$CLD_m[b] = 10\log_{10}\frac{\sum_{k=k_b}^{k_{b+1}-1} X_{ref}[k]X_{ref}^*[k]}{\sum_{k=k_b}^{k_{b+1}-1} X_m[k]X_m^*[k]},$$

and wherein m is the channel index, k is the index of a frequency bin, b is the index of a frequency band, $k_b$ is the start bin of band b, and $X_{ref}$ is the spectrum of the reference signal and $X_m$ is the spectrum of each channel of the multi-channel signal.

According to a twenty-first implementation form of the fourth embodiment, the multi-channel signal is a stereo signal, wherein the stereo signal comprises a first channel and a second channel.

According to a twenty-second implementation form of the fourth embodiment, the multi-channel signal is a stereo signal, wherein the first channel signal is a left channel signal and the second channel signal is a right channel signal of the stereo signal, or vice versa.

According to a twenty-third implementation form of the fourth embodiment, the multi-channel signal is a stereo signal, wherein the stereo signal comprises a first channel signal and a second channel signal, and wherein the reference signal is the first or the second channel signal or the downmix signal of the stereo signal.

Any implementation form of the fourth aspect may be combined with any other implementation form of the fourth aspect to obtain another implementation form of the fourth aspect.

According to a fifth aspect, a decoder for parametric multi-channel audio decoding is provided, the decoder comprising a downmix decoder, an upmixer and a device according to any of the implementation forms of the fourth aspect. The downmix decoder is configured to receive an encoded downmix signal representing a multi-channel signal and to decode the encoded downmix signal to generate a decoded downmix signal. The upmixer is configured to receive the decoded downmix signal from the downmix decoder and multi-channel parameters associated to the decoded downmix signal and to generate an upmixed decoded version of the downmix signal, the upmixed decoded version of the downmix signal forming the multi-channel signal.

According to a first implementation form of the fifth aspect, the decoder further comprises a demultiplexer adapted to receive a multiplexed audio signal and to extract from the multiplexed audio signal the encoded downmix signal and the multi-channel parameters, wherein the multi-channel parameters comprise at least a classification indication for at least one channel signal.

According to a second implementation form of the fifth aspect, the demultiplexer is adapted to extract for each of the channel signals a channel specific classification indication indicating a transient type of the respective channel signal.

According to a third implementation form of the fifth aspect, the downmix decoder is further adapted to extract from the encoded downmix signal a downmix classification indication indicating a transient type of the downmix signal, e.g. of the decoded downmix signal, and a time envelope.

According to a fourth implementation form of the fifth aspect, the multi-channel parameters comprise for each channel signal of the plurality of channel signals, or at least for a channel signal of a subset of the plurality of channel signals, a channel specific channel level difference associated to a respective channel.

Any implementation form of the fifth aspect may be combined with any other implementation form of the fifth aspect to obtain another implementation form of the fifth aspect.

According to a sixth aspect, a method for postprocessing at least one channel signal of a plurality of channel signals of a multi-channel signal is provided, the at least one channel signal being generated from a decoded downmix signal by a low-bit-rate audio coding/decoding system. The method comprises the following steps. Receiving the at least one channel signal generated from the decoded downmix signal, a time envelope of the decoded downmix signal and a classification indication indicating a transient type of the at least one channel signal, wherein the classification indication is associated to the at least one channel signal. Postprocessing the at least one channel signal based on the time envelope of the decoded downmix signal weighted by a respective weighting factor and in dependence on the classification indication. The implementation forms described with regard to the fourth and fifth aspect describe also corresponding implementation forms of the sixth aspect.

According to a seventh aspect, the invention relates to a computer program comprising a program code for executing the method for postprocessing a decoded multi-channel signal or for postprocessing a decoded stereo signal processed by a low-bit-rate audio coding system according to any of the implementation forms of the third or sixth aspect, when run on at least one computer.

The respective means, in particular the decoder, the receiver, the decider, the postprocessor, and the postprocessing entities are functional entities and can be implemented in hardware, in software or as combination of both, as is known to a person skilled in the art. If said means are implemented in hardware, it may be embodied as a device, e.g. as a computer or as a processor or as a part of a system, e.g. a computer system. If said means are implemented in software it may be embodied as a computer program product, as a function, as a routine, as a program code or as an executable object.

The stereo implementation forms of the fourth to sixth aspect form a specific implementation form of the multi-channel encoding/decoding because the stereo signal comprises only two channel signals (M=2), the left and the right channel signal, whereas the multi-channel signal may comprise two or more channel signals (M>=2).

The stereo implementation forms of the first to third aspect again can be regarded as a further development of the stereo/multi-channel stereo implementation forms according to the fourth to sixth aspects using one of the channel signals (i.e. the left or the right channel signal of the stereo signal) as reference signal for determining the channel transient type of the other channel signal (instead of using the downmix signal as reference signal). The stereo implementations of the first to third aspect make further use of the fact that because the stereo signal only comprises two channels the "channel transient classification indication" (and also the $CLD_m$) determined for one of the two channels with regard to the other of the two channel signals at the same time comprises transient information (or energy information) of the reference channel signal. Therefore, the stereo transient classification can be regarded as a specific case of the channel transient classification (of the multi-channel aspects) which is not only associated to one channel signal m but to both channel signals (left and right channel signals) of the stereo signal.

Thus implementation forms of the first to third aspect allow to even further reduce the required bandwidth for transmitting the stereo information, in particular the transient information and the energy information (e.g. CLD), as only one stereo classification needs to be transmitted, whereas in case the downmix signal is used as reference, implementation forms of the fourth to sixth aspect require two individual channel classification indications (for each of the two channels one).

Turning back to the implementation forms of the multi-channel aspects, in case one of the plurality of channel signals is used as reference signal, the channel transient classification indications for only M−1 channel signals (M being the number of the plurality of channel signals forming the multi-channel signal) are required. The transient classification of the reference signal itself is implicitly included in any of the channel transient classifications of the other M−1 channel signals and the postprocessing for the reference channel can be decided like in the implementation forms for the stereo coding according to first to third aspect. Correspondingly the decision, whether to postprocess the reference channel signal can be performed dependent on one of the M−1 channel transient classifications or dependent on the downmix transient classification information of the downmix signal in combination with one of the M−1 channel transient classifications.

In alternative implementation forms, the transient classification for the reference signal can be performed for the reference signal itself like for the downmix signal, i.e. like the downmix transient classification and without evaluating a relation to another signal.

BRIEF DESCRIPTION OF THE DRAWINGS

Further embodiments of the invention will be described with respect to the following figures in which.

DETAILED DESCRIPTION OF EMBODIMENTS OF THE INVENTION

Figure 1:
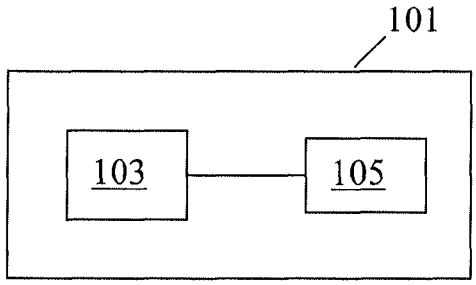
FIG. 1 shows an embodiment of a device for postprocessing a decoded stereo signal.

In FIG. 1, an embodiment of a device 101 for postprocessing a decoded stereo signal processed by a low-bit-rate audio coding system is illustrated. The device 101 is adapted to postprocess at least one of a left and a right channel signals of a stereo signal, the left and right channel signals being generated from a decoded downmix signal by a low-bit-rate audio coding/decoding system. As explained before, the downmix signal, in its encoded and decoded version, represents the stereo signal.

The device 101 has a receiver 103 and a postprocessor 105.

The receiver 103 is configured to receive a left channel signal and a right channel signal generated from the decoded downmix signal, a time envelope of the decoded downmix signal and a classification indication indicating a transient type of the stereo signal.

Further, the postprocessor 105 is adapted to postprocess at least one of the left and the right channel signals based on a weighted time envelope of the decoded downmix signal and in dependence on the classification indication. In detail, the classification indication may control which channel signal is postprocessed or that both channel signals are postprocessed. Further, the weighted time envelope of the decoded downmix signal may be a tool for postprocessing the selected channel signal or signals.

Figure 2:
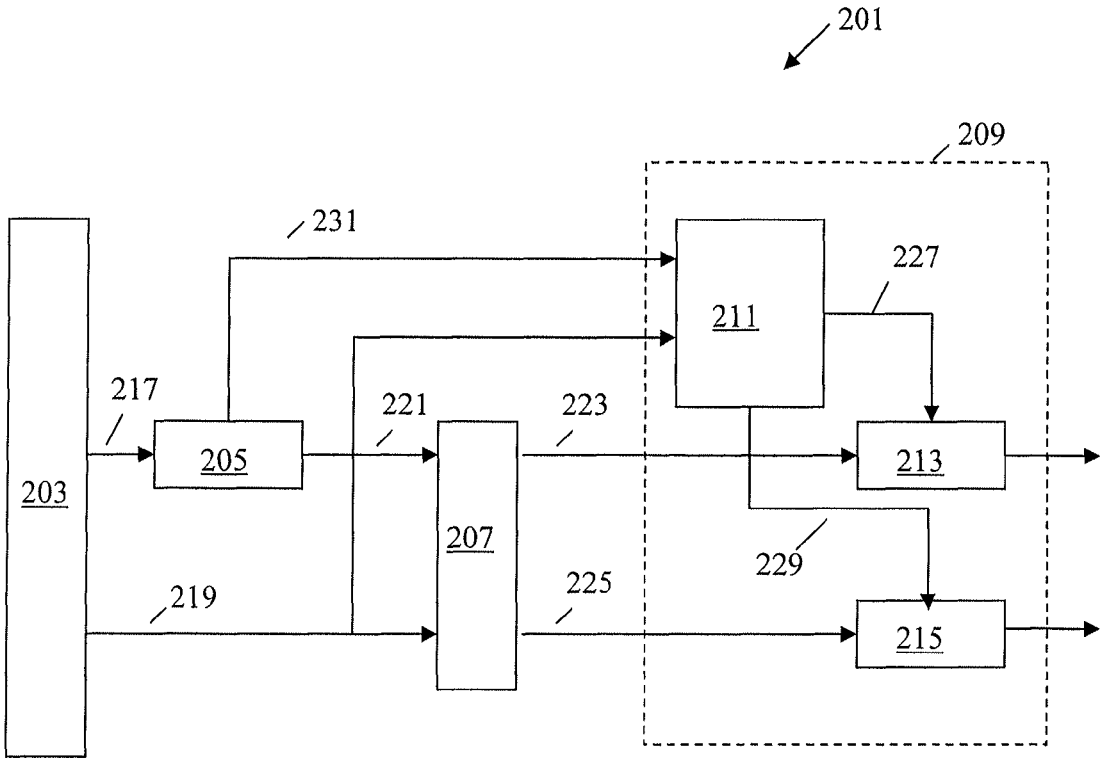
FIG. 2 shows a first embodiment of a decoder including a device for postprocessing a decoded stereo signal.

FIG. 2 shows a first embodiment of a decoder 201. The decoder 201 has a demultiplexer 203, a mono decoder 205, an upmixer 207 and a device 209 for postprocessing. The device 209 for postprocessing has a decider 211, a first postprocessing entity 213 and a second postprocessing entity 215.

The demultiplexer 203 provides a received downmix signal 217, e.g. a downmix bitstream 217, and further a signal 219, e.g. a set of parameters 219, including a channel level difference (CLD) and potentially further stereo parameters.

The mono decoder 205 is configured to receive the downmix signal 217 and to provide a decoded downmix signal 221 to the upmixer 207 and to the device 209.

The upmixer 207 receives the decoded downmix signal 221 and the CLD signal 219 for outputting a left channel signal 223 and a right channel signal 225.

The decider 211 of the device 209 is configured to receive a signal 231, e.g. a set of parameters 231, including the time envelope of the decoded downmix signal and a classification indication indicating the type of the decoded downmix signal. The classification indication indicates if the decoded downmix signal is transient or normal. The decider 211 of the device 209 further receives the signal 219.

The decider 211 is configured to decide which one or ones of the left and right channel signals 223, 225 are postprocessed. In particular, said decider 211 is configured to decide in dependence on a classification indication indicating a transient type of the stereo signal. This classification indication may be included in the signal 219. Further, said decider 211 may be configured to control the first processing entity 213 by means of a first control signal 227 and the second postprocessing entity 215 by means of a second control signal 229.

The first postprocessing entity 213 is configured to postprocess the left channel signal 223 using the received time envelope 231 of the decoded downmix signal, wherein said time envelope is weighted by a first weighting factor.

In an analogous way, said second postprocessing entity 215 is configured to postprocess the right channel signal 225 using the received time envelope 231 of the decoded downmix signal, said time envelope then being weighted by a second weighting factor.

In this regard, the decider 211 may be configured to calculate the first weighting factor and the second weighting factor in dependence on the received channel level difference 219 between the left and the right channels of the stereo signal.

Figure 3:
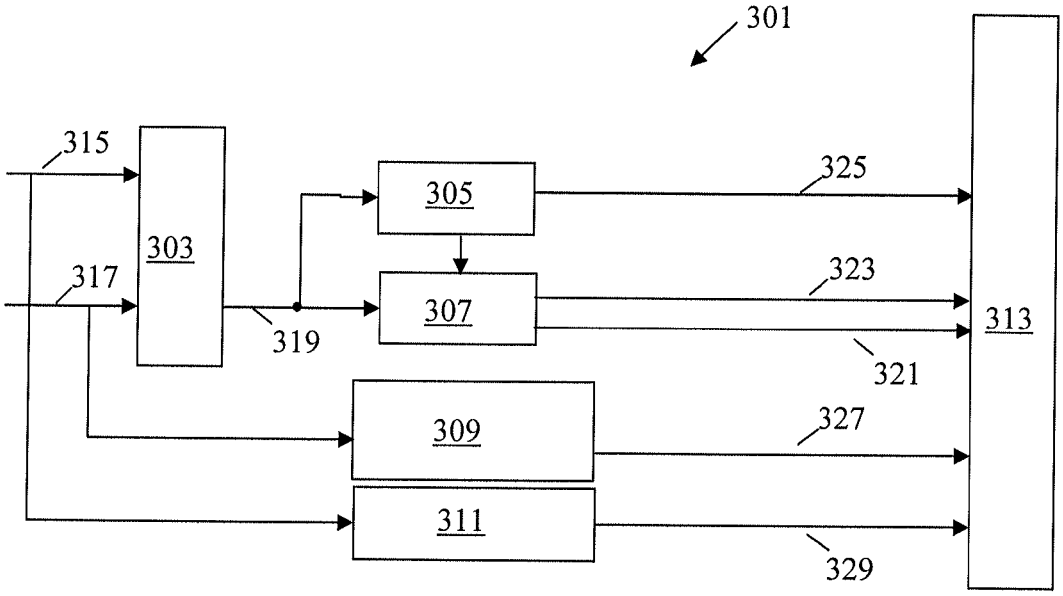
FIG. 3 shows a first embodiment of an encoder coupleable with the decoder of FIG. 2.

With regard to FIG. 2, FIG. 3 shows a first embodiment of an encoder 301 being coupleable with the decoder 201 of FIG. 2. The encoder 301 of FIG. 3 and the decoder 201 of FIG. 2 may be coupled by a transmission channel or any other communication link, e.g. a wired or wireless communication link.

The encoder 301 has a downmixer 303, a downmix transient detector 305, an encoding entity 307, an extractor 309, a detector 311 and a multiplexer 313.

Said downmixer 303 receives a left channel 315 and a right channel 317 of the stereo signal. The downmixer 303 outputs a downmix signal 319, said downmix signal 319 being provided to the downmix transient detector 305 and to the encoding entity 307.

As the downmixer is adapted to downmix the left and right channel to only one single mono downmix signal, the downmixer 303 can also be referred to as mono downmixer 303 and the downmix transient detector 305 as mono transient detector 305 or mono downmix transient detector.

The mono transient detector 305 is adapted to detect whether the mono downmix signal is transient or not, and to output a classification indication 325 indicating whether the mono downmix signal 319 is transient or not. The mono transient detector can be adapted to evaluate the energy of consecutive frames of the mono downmix signal and to detect that the mono downmix signal is transient when a change of the energy of the mono downmix signal from one frame to a consecutive frame exceeds a predetermined threshold.

As for this detection the dynamics or change over time of the mono downmix signal itself (or in general: of the downmix signal itself) is evaluated (in contrast to the stereo transient classification and the channel transient classification explained later, where the dynamics of the energy of two signals are evaluated) this transient classification is also referred to as mono transient classification (or in general: downmix transient classification) and the mono downmix signal is also referred to as being mono transient (or in general: downmix transient) in case the above condition is fulfilled, e.g. the change of the energy of the mono downmix signal (or in general: of the downmix signal) from one frame to a consecutive frame exceeds the predetermined threshold.

Therefore the classification indication 325 indicating a transient type of the (mono) downmix signal, which is the output of the mono transient detector 305, can also be referred to as mono transient classification indication or as transient classification indicating a mono transient type of the mono downmix signal, i.e. indicating whether the mono downmix signal is mono transient or not.

The encoding entity 307 outputs an encoded downmix signal 321, e.g. an encoded downmix bitstream 321, and a time envelope 323 of the downmix signal. The encoding entity can be adapted to extract the time envelope of the mono downmix signal only in case the mono transient detector detects that the mono downmix signal is mono transient. The encoding entity can be adapted, e.g. to divide the whole frame into four sub-frames, to calculate the energy of each sub-frame and to encode the square roots of energy of those four sub-frames to represent the time envelope of the downmix signal.

The extractor 309 is configured to extract CLD and other stereo parameters from the stereo signal. The extracted CLD and the other stereo parameters from the stereo signal may be transferred by a bitstream 327.

Moreover, the detector 311 is configured to provide a stereo transient detection and to output a classification indication 329 indicating a transient type of the stereo signal. The detector can be implemented to calculate the channel level difference CLD between the left and the right channel signal for consecutive frames of the stereo signal, and to detect that the stereo signal is transient, in case a change of the CLD of the stereo signal, i.e. between the left and the right channel signal of the stereo signal, from one frame to a consecutive frame exceeds a predetermined threshold.

As for this detection the dynamics or change over time of the relation of the energies of the left and right channel signal, i.e. of two signals, is evaluated (in contrast to the mono transient classification explained above or the general downmix transient classification described later, where the dynamics of the energy of only one signal is evaluated) this transient classification is also referred to as stereo transient classification and the stereo signal is also referred to as being stereo transient in case the above condition is fulfilled, e.g. the change of the CLD of the stereo signal from one frame to a consecutive frame exceeds a predetermined threshold.

Therefore, the detector 311 may also be referred to as stereo transient detector and the classification indication 329 indicating a transient type of the stereo signal can also be referred to as stereo transient classification indication or classification indication indicating a stereo transient type of the stereo signal, i.e. indicating whether the stereo signal is stereo transient or not.

Figure 4:
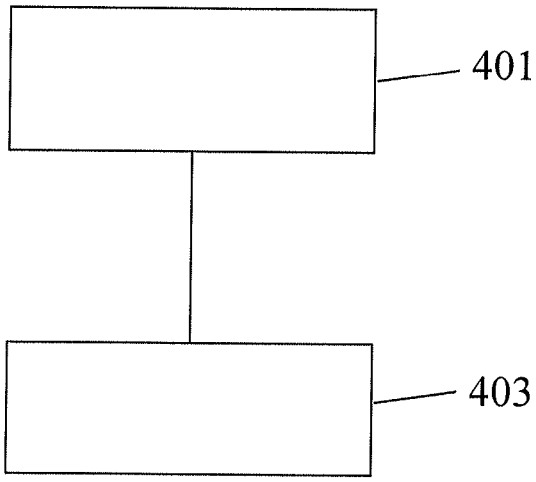
FIG. 4 shows a first embodiment of a method for postprocessing a decoded stereo signal.

In FIG. 4, a first embodiment of a method for postprocessing a decoded stereo signal is depicted. The method for postprocessing is adapted to postprocess at least one of the left and right channel signals of the stereo signal, the left and right channel signals being generated from a decoded downmix signal by a low-bit-rate audio coding/decoding system.

In a step 401, the left channel signal and the right channel signal generated from the decoded downmix signal, a time envelope of the decoded downmix signal and a classification indication indicating a transient type of the stereo signal are received.

In a step 403, at least one of the left and the right channel signals is postprocessed based on the time envelope of the decoded downmix signal weighted by a respective weighting factor and in dependence on the classification indication.

Figure 5:
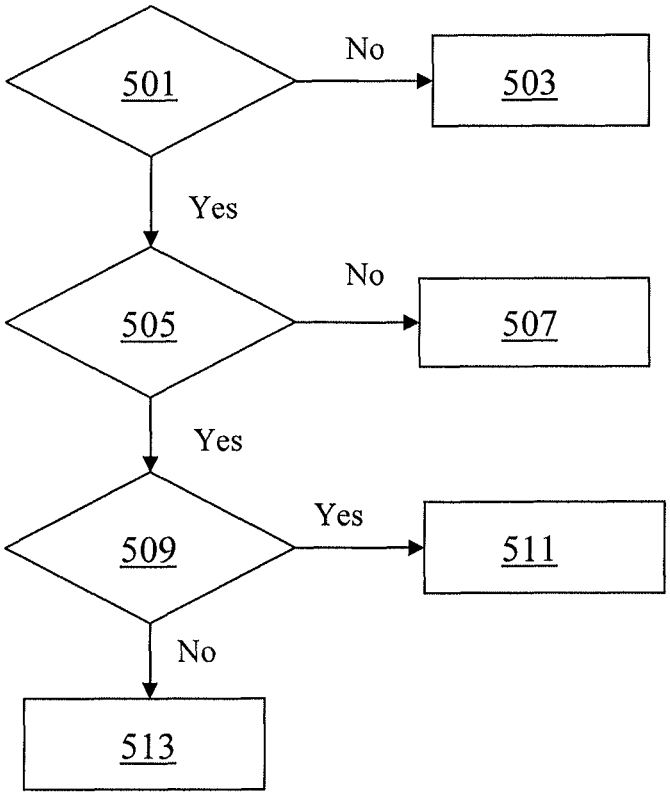
FIG. 5 shows a second embodiment of a method for postprocessing a decoded stereo signal.

Further, FIG. 5 shows a second embodiment of a method for postprocessing a decoded stereo signal. The method for postprocessing is adapted to postprocess at least one of the left and right channel signals of the stereo signal, the left and right channel signals being generated from a decoded downmix signal by a low-bit-rate audio coding/decoding system.

In a step 501, it is checked if the decoded downmix signal is transient or not.

If the decoded downmix signal is non-transient, only the memory is updated in a step 503 and none of the left and right channel signals is postprocessed by using the weighted time envelope. As the mono downmix signal is typically transient if one or both of the left and right channel signals is transient, it can be assumed that in case the classification indicator indicating the transient type of the downmix signal indicates that the downmix signal is not transient, i.e. the mono downmix signal is not mono transient, none of both of the left and right channel signals is transient, and, therefore no postprocessing is required.

If the decoded downmix signal is transient, the method proceeds with step 505. In the step 505, it is checked if the stereo signal is transient or not.

If the stereo signal is non-transient, both channels are postprocessed using a respective weighted time envelope of the decoded downmix signal in a step 507. The stereo transient classification indication can be regarded as an indicator, whether both channel signals, the left and right channel signal, have a different dynamic, i.e. have a different course over time. As the relation of the course of the left and right channel signals is evaluated, e.g. based on the CLD, the signal will, typically, be classified as stereo transient in case only one of both signals is transient or both are transient but not in the same or similar way, e.g. the energy of the left and right channel signal changes over time in different directions (increase or decrease) or by a different amount. The degree of the difference necessary for a stereo signal to be classified as stereo transient depends on the metric used, e.g. energy, and the predetermined threshold. In view of the aforementioned, in case the downmix signal is mono transient (see step 501) and the stereo signal is not stereo transient, it is assumed that both channel signals, the left and the right channel signal, are transient in a similar manner. Therefore, both channel signals are postprocessed using the respective weighted time envelopes to improve the quality of both signals.

If the stereo signal is transient, the method proceeds with step 509. In view of the explanations provided with regard to steps 505 and 507 in case the downmix signal is mono transient (see step 501) and the stereo signal is stereo transient, it is assumed that only one channel signal, the left or the right channel signal, is transient. Therefore, only one channel signal needs to be postprocessed using the respective weighted time envelope to improve the quality of the channel signal. Step 509 is used to determine, which of the both channel signals is the transient one to be postprocessed.

In the step 509, it is checked if the decoded CLD is greater than zero.

If the decoded CLD is greater than zero, the method proceeds with step 511. If not, the method proceeds with step 513.

In the step 511, the time envelope of the left channel is recovered using the weighted time envelope of the decoded downmix signal. Examples for calculating the weighting factor for weighting the time envelope of the decoded downmix signal are shown above.

In the step 513, the time envelope of the right channel is recovered using the weighted time envelope of the decoded downmix signal.

Referring to steps 509 to 513, as the left channel signal is the reference signal for the CLD calculation, i.e. is the channel signal in the numerator position of equation (1) defining the CLD, the decoded CLD is greater than zero if the energy of the left channel signal is larger than the energy of the right channel signal. As transient signals typically have higher energies than non-transient signals, the CLD can be used as indicator to decide, which of the both is the transient channel signal. Accordingly, in case the decoded CLD is greater than zero the left channel signal is assumed to be the transient channel signal and postprocessed using the respective weighted time envelope. In case the decoded CLD is smaller than zero the right channel signal is assumed to be the transient channel signal and postprocessed using the respective weighted time envelope.

In further embodiments, the right channel may be used as reference signal and other metrics may be used to determine, which of the two signals is the transient one.

Figure 6:
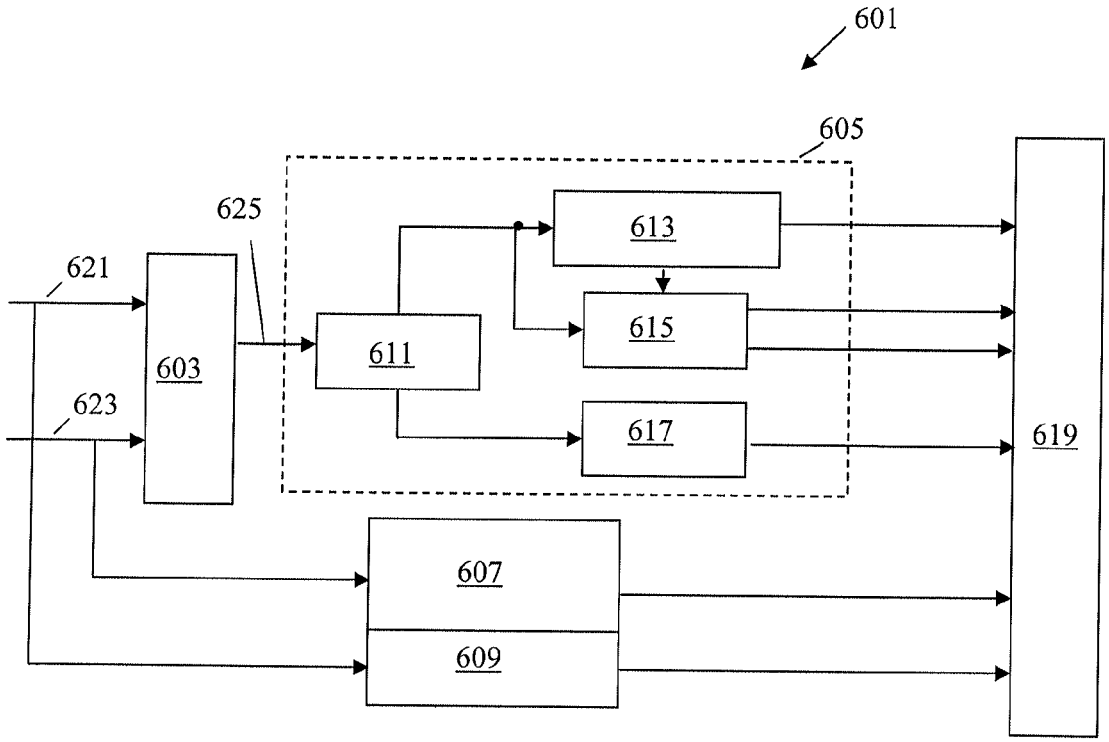
FIG. 6 shows a second embodiment of an encoder coupleable with the decoder of FIG. 7.
Figure 7:
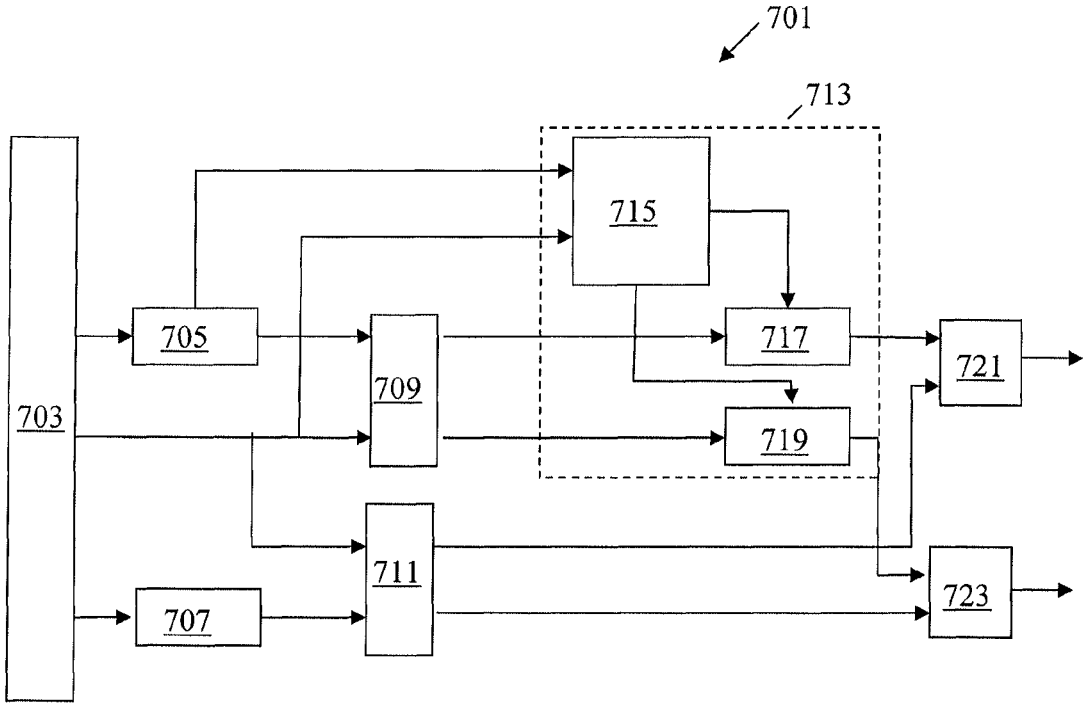
FIG. 7 shows a second embodiment of a decoder including a device for postprocessing a decoded stereo signal.

In FIG. 6, a second embodiment of an encoder 601 is shown. Said encoder 601 may be coupled with the decoder 701 of FIG. 7. The encoder 601 may be based on G.722/G.711.1 SWB mono.

The encoder 601 of FIG. 6 has a downmixer 603, a mono encoder 605, an extractor 607 and a detector 609. The extractor 607 is configured to extract CLD and other stereo parameters. The detector 609 is configured to provide a stereo transient detection.

The mono encoder 605 has a band splitter 611, a higher-band mono transient detector 613, a higher-band encoder 615 and a lower-band encoder 617.

Further, the encoder 601 has a multiplexer 619.

The downmixer 603 receives a left channel signal 621 and a right channel signal 623. A downmix signal 625 is generated from the left and the right channel signals 621 and 623 by said downmixer 603. The downmix signal 625 is input to the mono encoder 605.

The input downmix signal 625 is divided into the lower-band and the higher-band parts by the band splitter 611 being exemplarily embodied as QMF band-splitting filter. These are used as inputs to the lower-band encoder 617 and the higher-band encoder 615, respectively.

The higher-band mono transient detector 613 provides a transient detection based on the energy of the higher-band time signal of consecutive frames. The time envelope of the higher-band signal is extracted and transmitted to the decoder (see FIG. 7) together with the classification information.

For example, the whole frame may be divided into four sub-frames, and the energy of each sub-frame may be calculated. The square roots of energy of those four sub-frames may be encoded to represent the time envelope.

CLDs are extracted from the left and the right channel signals by using above-mentioned equation.

Further, a stereo transient may be detected by the stereo transient detector 609. This kind of detection may also be based on CLD monitoring. If a fast change or attack of CLD between two consecutive frames is detected, e.g. the change exceeds a predetermined threshold, the stereo signal may be classified as stereo transient. For example, the detection may be done in the following way. In a first step, the CLD sum of all the frequency bands is calculated in the log domain. In a second step, the average of the CLD sums of previous N frames is calculated. In a third step, the difference between the CLD sum of the current frame and the CLD sum mean of the previous N frames is calculated.

In a fourth step, the difference is compared to a threshold to decide if it is a transient stereo signal or not. The threshold may be based on experiments.

As mentioned above, FIG. 7 shows a second embodiment of a decoder 701 being coupleable with the decoder 601 of FIG. 6.

The decoder 701 has a demultiplexer 703, a SWB mono decoder 705, a WB mono decoder 707, a first upmixer 709, a second upmixer 711 and a device for postprocessing 713.

The device 713 for postprocessing has a decider 715, a first postprocessing entity 717 and a second postprocessing entity 719.

Further, the decoder 701 has a first quadrature mirror filter (QMF) 721 outputting the decoded and postprocessed left channel signal.

Further, the decoder 701 has a second quadrature mirror filter (QMF) 723 for outputting the decoded and postprocessed right channel signal.

Thus, the lower-band stereo and the higher-band stereo signals may be reconstructed separately as shown by the outputs of the upmixers 709 and 711, and may be used as input signals of the QMF filter 721 and 723 to generate the output stereo signal. In particular, the stereo postprocess algorithm may be only applied to the higher-band decoder.

Figure 8:
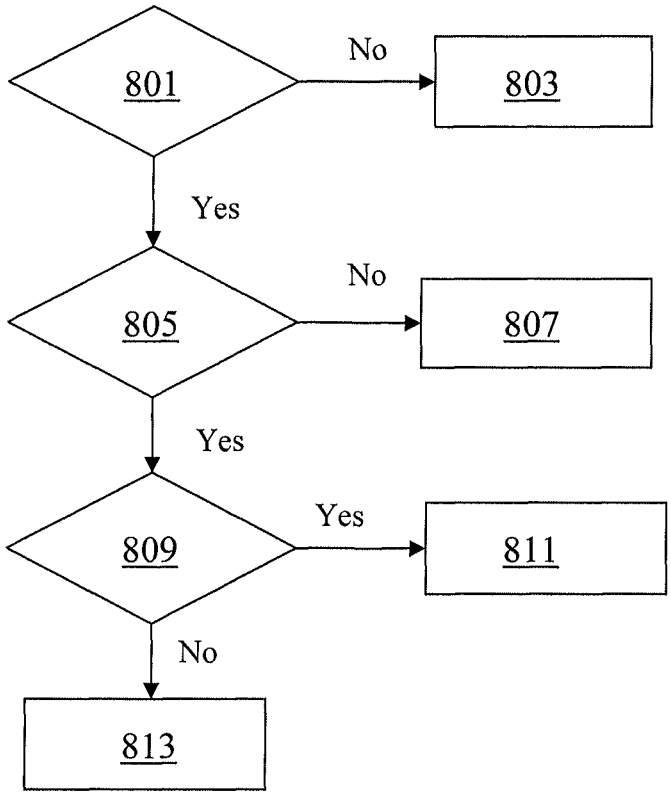
FIG. 8 shows a third embodiment of a method for postprocessing a decoded stereo signal.

FIG. 8 shows a third embodiment of a method for postprocessing a decoded stereo signal. The method for postprocessing is adapted to postprocess at least one of the left and right channel signals of the stereo signal, the left and right channel signals being generated from a decoded downmix signal by a low-bit-rate audio coding/decoding system. The explanations provided with regard to FIG. 5 apply correspondingly.

In a step 801, it is checked if the decoded downmix signal is transient or not. If the decoded downmix signal is non-transient, only an update of the memory is performed as shown in step 803 and none of the two channel signals, neither the left nor the right channel signal, is postprocessed using the weighted time envelope.

The check of step 805 is answered yes, if the stereo signal of the current frame is transient or if the decoded downmix signal of the previous frame is transient and the stereo signal of the previous frame is transient. If the step 805 is answered no, the method proceeds with step 807. If the step 805 is answered yes, the method proceeds with step 809.

In the step 807, both channels are postprocessed using the weighted time envelopes of the decoded downmix signal because it is assumed that both channel signals, the left and the right channel signal, are transient.

For the embodiment according to FIG. 8, the left channel signal is again (like in FIG. 5) used as reference and the received CLD according to equation (1) is used for deciding, which of the two signals, the left or the right channel signal, is the transient signal. Therefore, in the step 809, it is checked if the decoded CLD is greater than zero.

If the decoded CLD is greater than zero, the method proceeds with step 811. If not, the method proceeds with step 813.

In the step 811, the time envelope of the left channel is recovered using the weighted time envelope of the decoded downmix signal. Examples for calculating the weighting factor for weighting the time envelope of the decoded downmix signal are shown above.

In the step 813, the time envelope of the right channel is recovered using the weighted time envelope of the decoded downmix signal.

Recapitulating the above, if the stereo signal of a current frame is classified as stereo transient, or if the downmix signal was transient and the stereo signal classified as stereo transient at the previous frame, a further decision based on decoded CLD may be needed. Otherwise, both channels may be postprocessed using the weighted mono time envelopes for left and right channel, respectively.

When an additional decision is needed, the CLD may be used. A parameter named CLD_dq may be used to decide the energy relation of two channels. It may be calculated as the average of all higher bands CLD using the above mentioned equation (2). Further, the CLD of the first band of higher band may be used as the CLD_dq.

If only one channel is transient, the energy of that channel is higher than the energy of the other channel. Therefore, the energy information may be used to identify which channel is transient.

If CLD_dq is positive, the energy of the left channel is higher than the energy of the right channel, postprocessing may only be applied to the left channel using the weighted mono time envelope. If CLD_dq is negative, the energy of the left channel is smaller than the energy of right channel, postprocessing may only be applied to the right channel using the weighted mono time envelope. The weighted factor of both channels may be calculated by using equations above mentioned equations (4) and (5), respectively.

Figure 9:
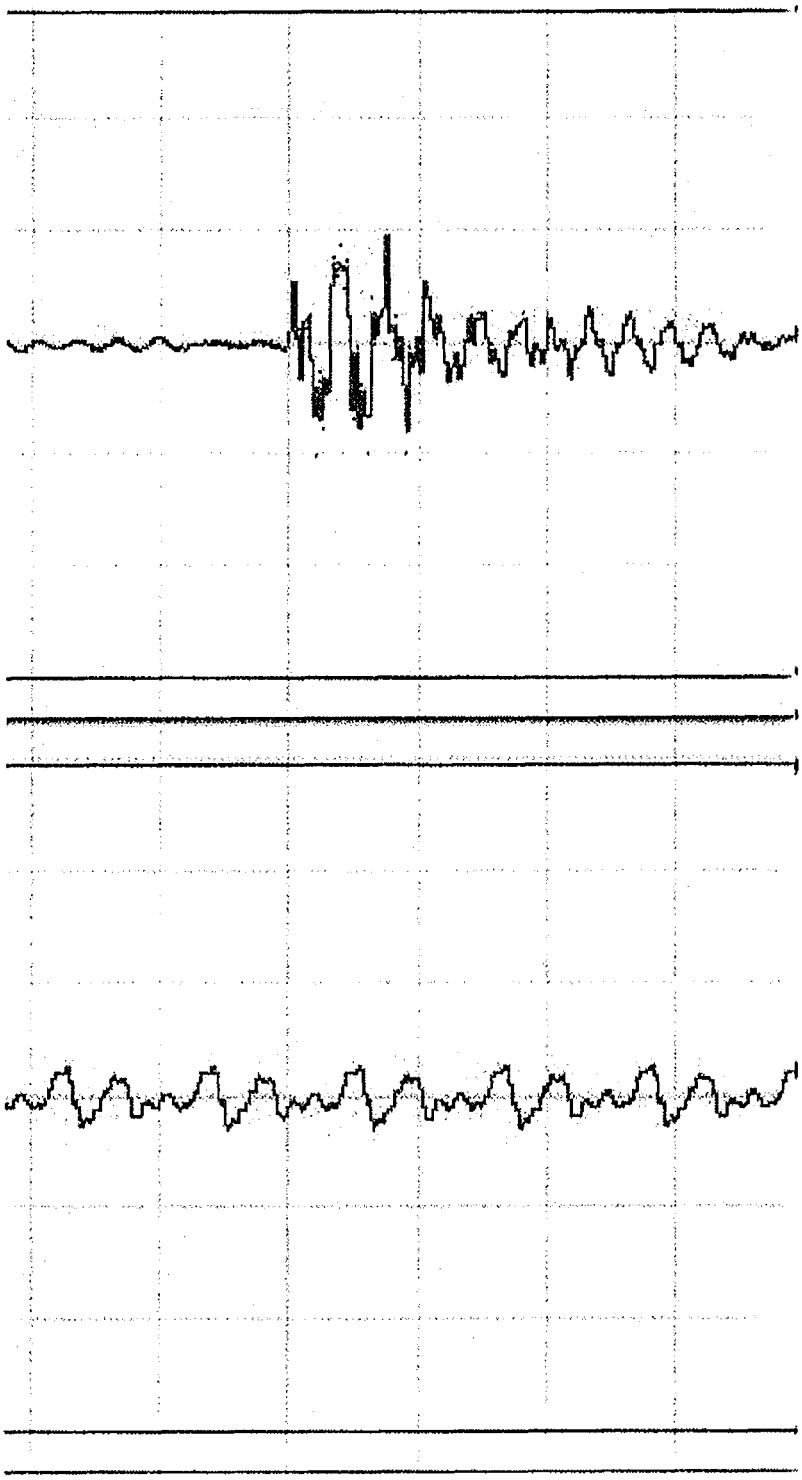
FIG. 9 shows a diagram illustrating an original stereo signal having one transient channel and one normal channel.
Figure 10:
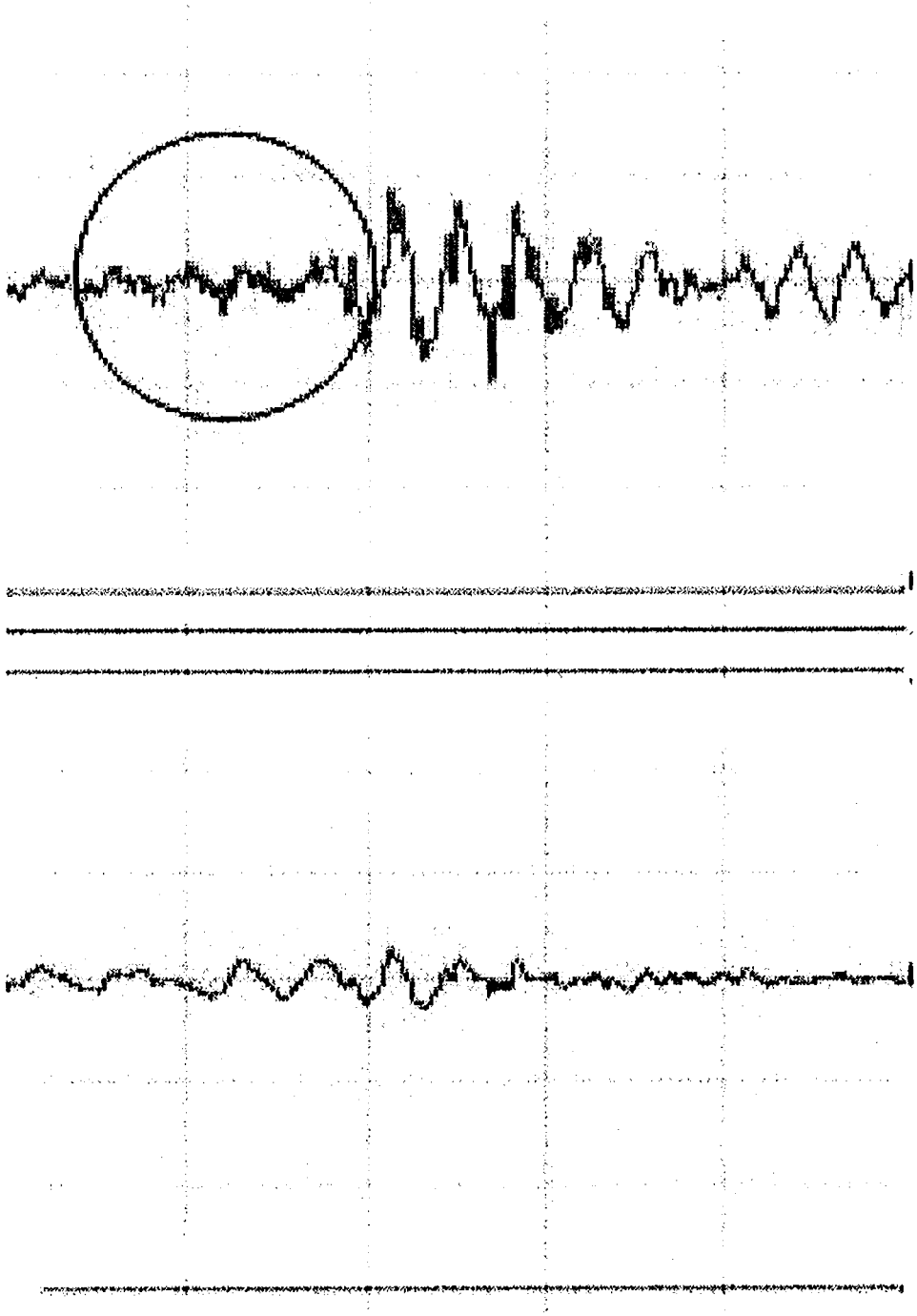
FIG. 10 shows a diagram illustrating the output stereo signal without postprocessing.
Figure 11:
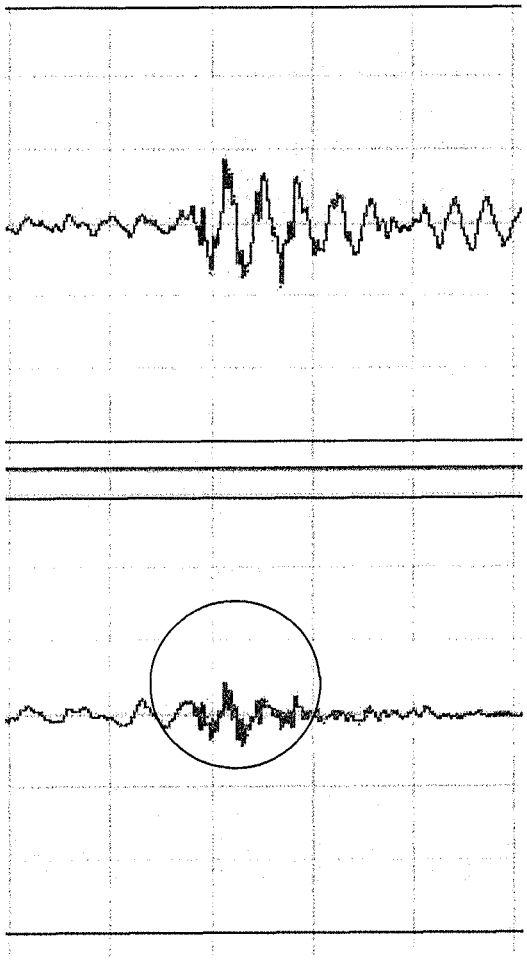
FIG. 11 shows a diagram illustrating the output stereo signal with postprocessing for both channels.
Figure 12:
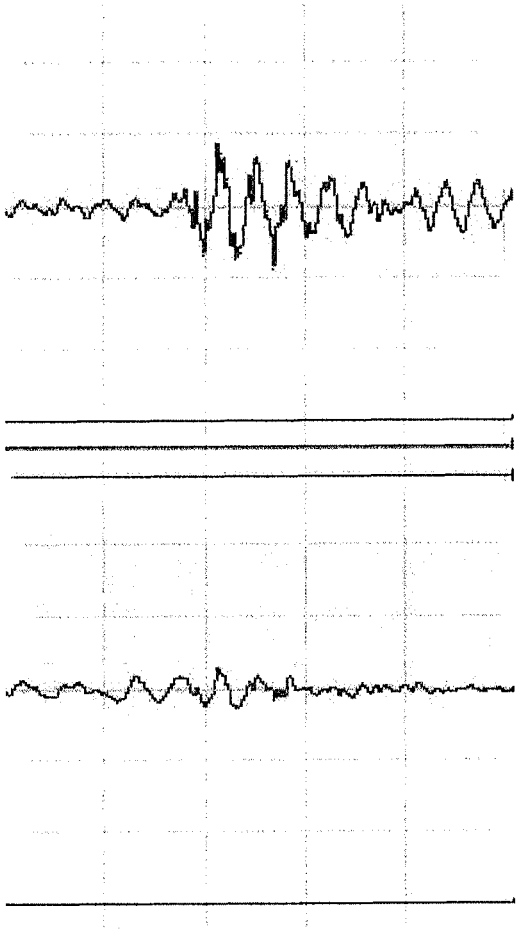
FIG. 12 shows a diagram illustrating the output stereo signal with postprocessing only the left channel which is transient.

FIG. 9 to 12 show performances illustrating that according to implementations of the present invention the pre-echo artefacts of a stereo signal having at least one transient channel may be eliminated. The top charts of FIGS. 9 to 12 depict the left channel signal and the bottom charts depict the right channel signal. In this regard, FIG. 9 shows a diagram illustrating an original stereo signal having one transient channel (top chart) and one normal channel (bottom chart), FIG. 10 shows a diagram illustrating the output stereo signal without postprocessing, FIG. 11 shows a diagram illustrating the output stereo signal with postprocessing for both channels, and FIG. 12 shows a diagram illustrating the output stereo signal with postprocessing only the left channel which is transient.

With respect to FIG. 10, if no postprocessing is applied to the reconstructed stereo signal, obvious pre-echo artifacts may be observed in the circle of FIG. 10. If postprocessing is applied to both channels, noise may be found in the right channel (see the circle in FIG. 11). The present algorithm may improve the situation with a better reconstructed time envelope for both channels in all the combinations of transient signals, i.e. left and right channels, only left channel, or only right channel.

Figure 13:
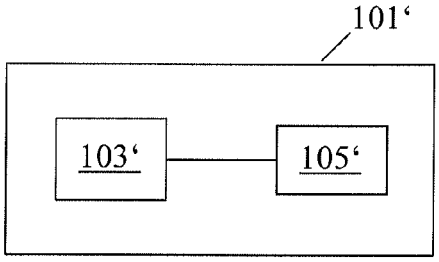
FIG. 13 shows an embodiment of a device for postprocessing a decoded multi-channel signal.

In FIG. 13, an embodiment of a device 101' for postprocessing a decoded multi-channel signal processed by a low-bit-rate audio coding system is illustrated. The device 101' is adapted to postprocess at least one channel signal of a plurality of channel signals of the multi-channel signal, the at least one channel signal being generated from a decoded downmix signal by the low-bit-rate audio coding/decoding system. As explained, the downmix signal, in its encoded and decoded version, represents the multi-channel signal.

The device 101' has a receiver 103' and a postprocessor 105'.

The receiver 103' is configured to receive at least one channel signal of a plurality of M channel signals of the multi-channel signal, the at least one channel signal being generated from the decoded downmix signal, a time envelope of the decoded downmix signal and a classification indication indicating a transient type of the at least one channel signal.

Further, the postprocessor 105' is adapted to postprocess the at least one channel signal based on a weighted time envelope of the decoded downmix signal and in dependence on the classification indication. The classification indication can be used to control, whether the at least one channel signal is postprocessed. Further, the weighted time envelope of the decoded downmix signal may be a tool for postprocessing the selected channel signal.

The plurality M is larger than one, i.e. M>1. In the following m is used as index to describe a particular channel signal of the plurality M of channel signals.

A further embodiment can comprise a receiver 103' configured to receive some or all of the plurality of channel signals of the multi-channel signal, each of the channel signals being generated from the decoded downmix signal, a time envelope of the decoded downmix signal and a classification indication for each of the channel signals (or at least for each of a subset of the channel signals), each of the channel specific classification indications indicating a respective transient type of the corresponding channel signal. The postprocessor 105' of the further embodiment is adapted to postprocess at least one channel signal of the plurality of channel signals based on a weighted time envelope of the decoded downmix signal and in dependence on the classification indication. The classification indication can be used to control, which of the plurality of channel signals is postprocessed.

According to a further embodiment, the device further comprises a decider. The decider is adapted to receive the classification indication and to control the postprocessor dependent on the classification indication, whether to postprocess the at least one channel signal using the channel specifically weighted time envelope.

According to an even further embodiment, the device comprises a decider, wherein the decider is adapted to receive the classification indication and a further classification indication indicating, whether the downmix signal is transient, and to control the postprocessor dependent on the classification indication and the further classification indication, whether the postprocessor postprocesses the at least one channel signal using the channel specifically weighted time envelope.

In an alternative embodiment, the postprocessor 105' is adapted to receive the time envelope of the decoded downmix signal and the channel specific weighting factor, and to generate the weighted time envelope by multiplying the time envelope with the channel specific weighting factor.

Embodiments of the postprocessor may comprise only one postprocessing entity adapted to postprocess one, several or all of the channel signals. The decision which of the plurality of the channel signals is postprocessed is controlled by the decider. Other embodiments may comprise more than one postprocessing entity, e.g., for each channel signal a dedicated postprocessing entity or postprocessing entities adapted to postprocess more than one channel signal according to the control of the decider.

Figure 14:
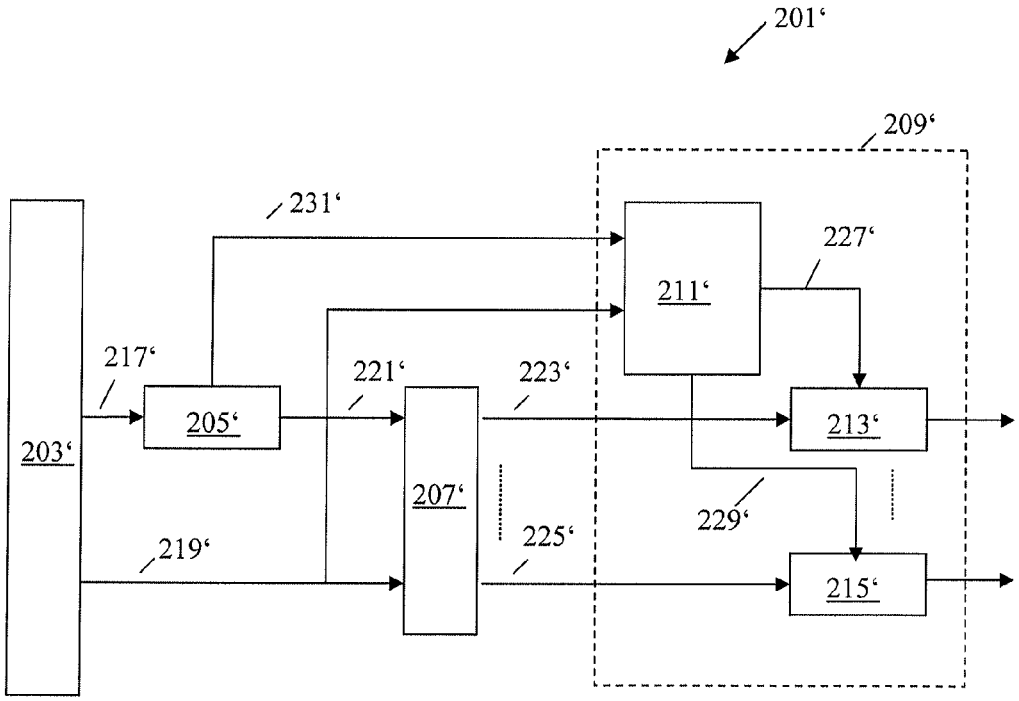
FIG. 14 shows a third embodiment of a decoder including a device for postprocessing a decoded multi-channel signal.

FIG. 14 shows a third embodiment of a decoder 201', i.e. a decoder for parametric multi-channel audio decoding. The decoder 201' has a demultiplexer 203', a downmix decoder 205', an upmixer 207' and a device 209' for postprocessing. The device 209' for postprocessing has a decider 211', a first processing entity 213' and a second post processing entity 215'.

The demultiplexer 203' is adapted to receive a multiplexed audio signal comprising the downmix signal and the multi-channel parameters, and to demultiplex the received signal, e.g. bitstream, to output the received downmix signal 217', e.g. downmix bitstream 217', and the multi-channel audio coding parameters 219' associated to the received downmix signal 217'. The multi-channel audio coding parameters include a channel level difference (CLD) for each of the channel signals of the multi-channel signal represented by the downmix signal, the channel specific channel level difference being in the following referred to as $CLD_m$, wherein m represents the channel index specifying a channel of the plurality M of channel signals of the multi-channel signal.

The downmix decoder 205' is configured to receive the encoded downmix signal 217' and to provide a decoded downmix signal 221' to the upmixer 207' and to the device 209' for postprocessing.

The upmixer 207' is adapted to receive the decoded downmix signal 221' and the channel specific channel level differences $CLD_m$, and is adapted to generate and output based on the aforementioned decoded downmix signal 221' and the channel-specific $CLD_m$ the M channel signals of the multi-channel signal (indicated by the exemplary two reference signs 223' and 225'). The dots between the signal lines referenced with reference numbers 223' and 225' indicate that the multi-channel signal can have more than M=2 channel signals. The decider 211' of the device 209' is configured to receive a signal 231' including the time envelope of the decoded downmix signal and a classification indication indicating the transient type of the decoded downmix signal. The classification indication indicates whether the decoded downmix signal is transient or normal, e.g. not transient. The decider 211' of the device 209' is further adapted to receive the channel specific $CLD_m$ and the channel specific classification information (see signal 219).

The decider 211' is configured to decide which one or ones of the plurality M of channel signals 223', 225' are postprocessed. The decider 211', in other words, is configured to decide, whether none of the channel signals is postprocessed, whether all of the M channel signals are postprocessed, or if only a subset of the channel signals is postprocessed. The decider 211' is configured to decide dependent on the classification indication indicating for each of the channel signals a transient type of the respective channel signal, i.e. indicating for each of the channel signals whether the respective channel signal is transient or normal. This classification indication may be included in the signal 219'. Further, the decider 211' can be configured to control the processing entities 213', 215' by means of respective control signals. In FIG. 14, the control signal 227' for controlling the postprocessing entity 213' is shown and the control signal 229' for controlling the postprocessing entity 215'. The postprocessing entity 213' is configured to postprocess the channel signal 223' using the received time envelope 231' of the decoded downmix signal, wherein the time envelope is weighted by a channel specific weighting factor associated to the channel signal 223'.

In an analogous way, the postprocessing entity 215' is configured to postprocess the channel signal 225' using the received time envelope 231' of the decoded downmix signal, wherein the time envelope is weighted by a channel specific weighting factor associated to the channel signal.

The decider 211' can be configured to calculate or determine the weighting factor associated to the channel signal 223' and the weighting factor associated to the channel signal 225' dependent on the respective received channel level difference $CLD_m$ 219'.

Figure 15:
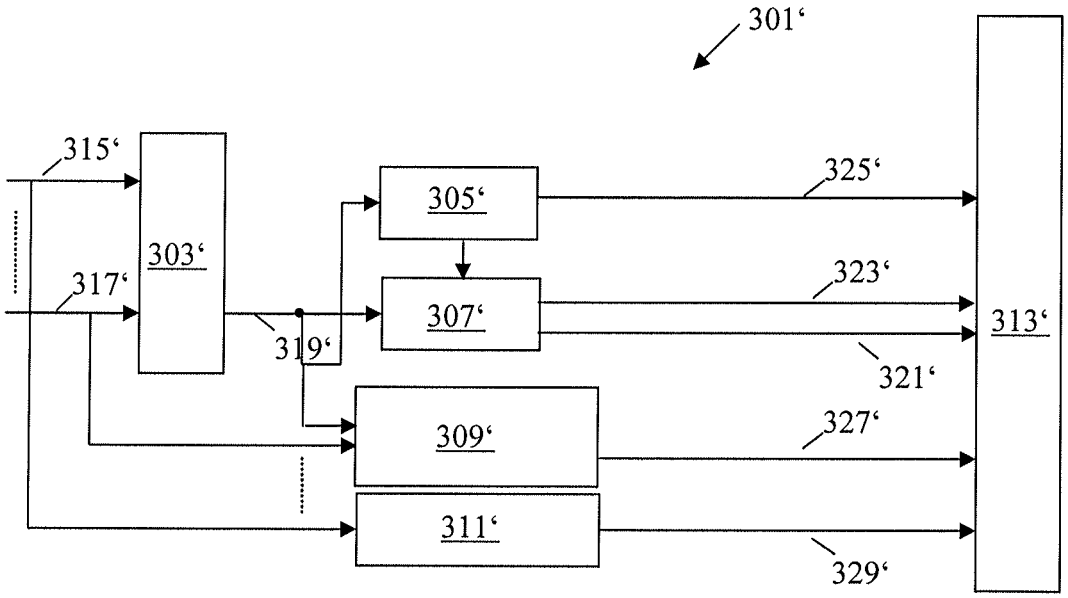
FIG. 15 shows a third embodiment of an encoder coupleable with the decoder of FIG. 14.

With regard to FIG. 14, FIG. 15 shows a third embodiment of an audio encoder, e.g. a parametric multi-channel audio encoder 301' for providing the encoded multi-channel audio signal to be decoded by the decoder of FIG. 14. The encoder 201' of FIG. 14 can be connected to the encoder 301' of FIG. 15 by a transmission channel, for example a wired or wireless communication link.

The encoder 301' has a downmixer 303', a downmix transient detector 305', an encoding entity 307', an extractor 309', a detector 311' and a multiplexer 313'.

The downmixer 303' receives the plurality M of channel signals of the multi-channel signal. For simplicity purposes, in FIG. 15 only two representative channel signals 315' and 317' of the plurality M of channel signals are shown. The downmixer 303' is further adapted to generate and output a downmix signal 319', the downmix signal 319' being provided to the downmix transient detector 305' and to the downmix encoding entity 307'. Optionally, in case the downmix signal is used as reference signal for determining the channel transient classification of the channel signals and/or the channel level difference CLD for the channel signals, the downmix signal may also be provided to the extractor 309' and detector 311'.

The downmix transient detector 305' is adapted to detect whether the downmix signal is transient or not, and to output a classification indication 325' indicating whether the downmix signal 319' is transient or not. The downmix transient detector can be adapted to evaluate the energy of consecutive frames of the downmix signal and to detect that the downmix signal is transient when a change of the energy of the downmix signal from one frame to a consecutive frame exceeds a predetermined threshold.

As for this detection the dynamics or change over time of the downmix signal itself is evaluated (in contrast to the stereo transient classification already explained and the channel transient classification explained later, where the dynamics of the energy of two signals are evaluated) this transient classification is also referred to as downmix transient classification and the downmix signal is also referred to as being downmix transient in case the above condition is fulfilled, e.g. the change of the energy of the downmix signal from one frame to a consecutive frame exceeds the predetermined threshold.

Therefore the classification indication 325' indicating a transient type of the downmix signal, which is output by the downmix transient detector 305', can also be referred to as downmix transient classification indication or as transient classification indicating a downmix transient type of the downmix signal, i.e. indicating whether the downmix signal is downmix transient or not.

The encoding entity 307' is adapted to output the encoded downmix signal 321' and a time envelope 323' of the downmix signal, e.g. as part of the downmix signal 321'. The encoding entity 307' can be adapted to extract the time envelope of the downmix signal only in case the downmix transient detector detects that the downmix signal is downmix transient. The encoding entity can be adapted, e.g. to divide the whole frame into four sub-frames, to calculate the energy of each sub-frame and to encode the square roots of energy of those four sub-frames to represent the time envelope of the downmix signal.

The downmix transient detector 305' is adapted to output a classification indication 325' indicating whether the downmix signal 319' is downmix transient or not, or in other words, whether the downmix signal 319' is transient or normal. Like the time envelope 323', the classification indication 305' is sent together with the downmix signal, e.g. as part of it, to the decoder.

The extractor 309' is configured to receive the M channel signals of the multi-channel signal and to extract for each channel m of the multi-channel signal a channel specific channel level difference $CLD_m$ and other multi-channel audio coding parameters from the multi-channel signal. The extracted $CLD_m$ and the other multi-channel coding parameters from the multi-channel signal are transferred by a signal 327' as side information to the decoder.

The detector 311' is configured to receive the M channel signals of the multi-channel signal and to provide a channel transient detection for each of the channel signals and to output for each of the channel signals a channel specific classification indication 329' indicating the transient type of the respective channel signals.

The detector 311' can be implemented to calculate a channel level difference CLDm for each channel signal m for consecutive frames of the multi-channel signal, and to detect that the channel signal m is transient, in case a change of the CLD associated to the channel signal m, e.g. the CLD calculated between the channel signal m and a reference signal, from one frame to a consecutive frame exceeds a predetermined threshold. The reference signal can be the downmix signal of the multi-channel signal, any of the channel signals or any other signal derived from at least one of the channel signals, e.g. an additional downmix signal generated from a subset of the plurality of channel signals.

As for this detection the dynamics or change over time of the relation of the energies of the actual channel signal m and the reference signal, i.e. of two signals, is evaluated (in contrast to the downmix transient classification explained above and the mono transient classification as explained previously, where the dynamics of the energy of only one signal is evaluated) this transient classification is also referred to as channel transient classification to distinguish it from the mono or downmix transient classification and the stereo transient classification. Accordingly, the channel signal is also referred to as being channel transient in case the above condition is fulfilled, e.g. the change of the $CLD_m$ associated to the channel m signal from one frame to a consecutive frame exceeds a predetermined threshold.

Therefore, the detector 311 may also be referred to as channel transient detector and the classification indication 329 indicating a transient type of the channel signal can also be referred to as channel transient classification indication or classification indication indicating a channel transient type of the channel signal, i.e. indicating whether the channel signal is channel transient or not.

According to an embodiment, the downmix transient detector 305' is adapted to control (see arrow from 305' to 307') the encoding entity 307' such that the encoding entity only determines a time envelope 323' of the downmix signal in case the downmix transient detector 305' detects that the downmix signal is downmix transient.

In alternative embodiments, the encoding entity 307' can be adapted to determine the time envelope 323' independent of, whether the downmix transient detector has detected that the downmix signal is downmix transient.

FIGS. 14 and 15 show embodiments for mono downmix coding. Therefore, encoder (FIG. 15) comprises a mono downmixer 303', adapted to downmix the plurality of channel signals to only one single mono downmix signal 319', a mono downmix encoding entity 307' adapted to encode the mono downmix signal 319', and mono transient detector 305' to detect whether the mono downmix signal is mono transient or not. Correspondingly, the decoder (FIG. 14) comprises a mono downmix decoder 205' adapted decode the received encoded mono downmix signal 205', and a mono upmixer 207' adapted to generate the plurality of M channel signals 213', 215' from the one decoded mono downmix signal 221'.

Alternative embodiments of the encoder and decoder can be implemented to perform multiple or stereo downmix coding, e.g. can be implemented to downmix a multi-channel signal such that the multi-channel signal is represented by two or more downmix signals (but typically less than M) and corresponding sets of spatial audio parameters to be able to reconstruct the channel signals from the more than two downmix signals. Each downmix signal is derived from at least two of the more than two channel signals of the multi-channel signal. In such embodiments, the encoder comprises a downmixer adapted to downmix the plurality of channel signals to the two or more downmix signals, one or more downmix encoding entities adapted to encode the downmix signals, and one or more downmix transient detectors adapted to detect at least whether one of the downmix signals is downmix transient or not. Correspondingly, the decoder comprises one or more downmix decoder adapted decode the received encoded downmix signals, an upmixer 207' adapted to generate the plurality of M channel signals 213', 215' from the two or more decoded downmix signals, and a decider adapted to evaluate for at least one of the downmix signals whether it is classified as downmix transient or not.

Figure 16:
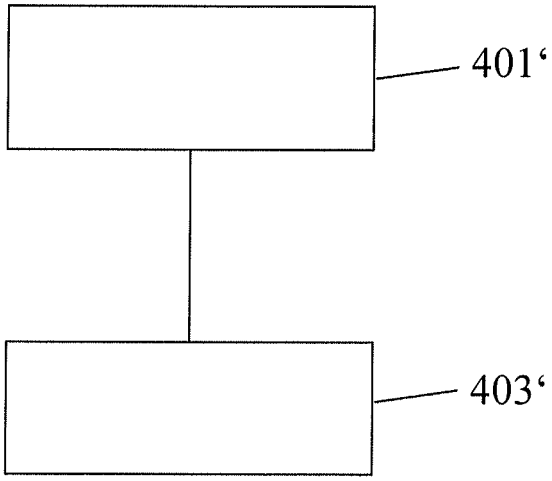
FIG. 16 shows a first embodiment of a method for postprocessing a decoded multi-channel signal.

FIG. 16 shows a flow chart of a first embodiment of a method for postprocessing a decoded multi-channel signal. The method for postprocessing is adapted postprocess at least one channel signal of a plurality of channel signals of the multi-channel signal, the at least one channel signal being generated from a decoded downmix signal by a low-bit-rate audio coding/decoding system. As explained, the downmix signal, in its encoded and decoded version, represents the multi-channel signal. The method comprises the following steps.

Receiving 401' the at least one channel signal generated from the decoded downmix signal, a time envelope of the decoded downmix signal and a classification indication indicating a transient type of the at least one channel signal, wherein the classification indication is associated to the at least one channel signal.

Postprocessing 403' the at least one channel signal based on the time envelope of the decoded downmix signal weighted by a respective weighting factor and in dependence on the classification indication.

Figure 17:
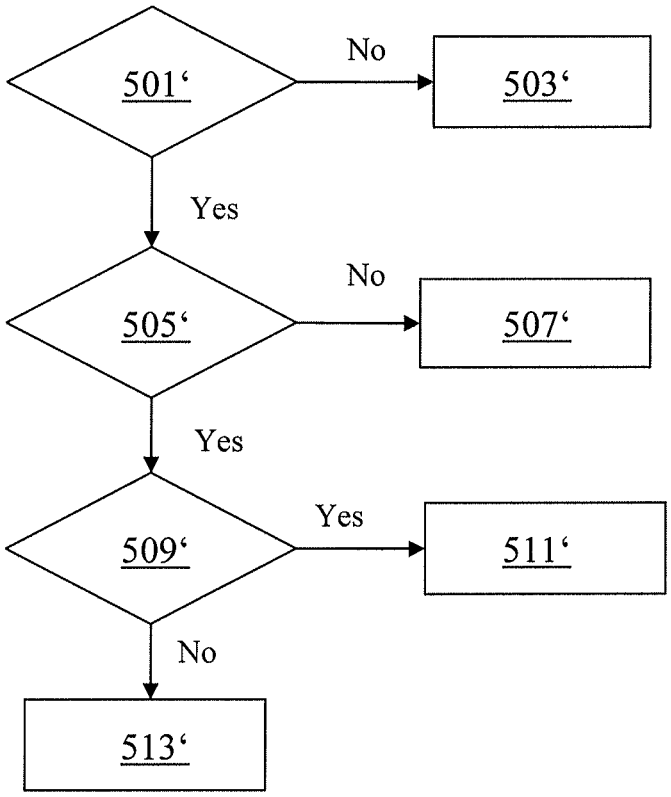
FIG. 17 shows a second embodiment of a method for postprocessing a decoded multi-channel signal.

FIG. 17 shows a flow chart of a second embodiment of a method for postprocessing a decoded multi-channel signal, wherein the downmix signal is used as reference signal. The method for postprocessing is adapted postprocess at least one channel signal of a plurality of channel signals of the multi-channel signal, the at least one channel signal being generated from the decoded downmix signal by a low-bit-rate audio coding/decoding system. As explained, the downmix signal, in its encoded and decoded version, represents the multi-channel signal. The method comprises the following steps.

Step 501' comprises checking whether the downmix signal is transient or not.

In case the downmix signal is not transient, only the memory is updated in step 503'. No postprocessing of any of the multi-channel signals using the channel specifically weighted time envelopes of the downmix signal is performed. As the downmix signal is typically transient if at least one of the channel signals of the multi-channel signal from which it was derived is transient, it can be assumed that in case the classification indicator indicating the transient type of the downmix signal indicates that the downmix signal is not transient, i.e. the downmix signal is not downmix transient, none of channel signals is transient, and, therefore no postprocessing is required.

If the decoded downmix signal is transient the method proceeds with step 505'. Step 505' comprises checking, whether channel m is transient or not. The channel transient classification indication can be regarded as an indicator, whether the channel m has a different dynamic compared to the reference signal, i.e. whether the channel signal m and the reference signal have a different course over time. As the relation of the course of the channel signal m and the reference signal is evaluated, e.g. based on the CLD, the signal will, typically, be classified as channel transient in case only one of both signals is transient or both are transient but not in the same or similar way, e.g. the energy of the channel signal m and of the reference channel signal change over time in different directions (increase or decrease) or by a different amount. The degree of the difference necessary for a channel signal to be classified as channel transient depends on the metric used, e.g. energy, and the predetermined threshold. In view of the aforementioned, in case the downmix signal is classified as downmix transient (see step 501) and the channel signal is not channel transient, it is assumed that both signals, the channel signal m and the reference signal, are transient in a similar manner.

Therefore, in case the channel signal m is not channel transient, the method proceeds with step 507' and channel m is postprocessed using the time envelope of the downmix signal weighted by the channel specific weighting factor.

In case the channel signal m is transient, the method proceeds with step 509'. Step 509' comprises checking whether the channel specific $CLD_m$ for the channel m is greater than 0.

In case the channel specific $CLD_m$ is greater than 0, the method proceeds with step 511'. If not, the method proceeds with step 513'.

In step 511', no postprocessing is performed on the multi-channel signal m, or in other words, the channel signal m is not processed with a weighted channel time envelope.

Step 513' comprises recovering or reconstructing the time envelope of the channel signal m by weighting the time envelope of the downmix signal by the channel specific weighting factor.

Referring to steps 509' to 513', as the reference channel signal is the reference signal for the CLD calculation, i.e. is the channel signal in the numerator position of equation (5) defining the $CLD_m$, the decoded $CLD_m$ is greater than zero if the energy of the reference signal is larger than the energy of the channel signal m. As transient signals typically have higher energies than non-transient signals, the $CLD_m$ can be used as indicator to decide, whether channel signal m can be regarded as transient with regard to the reference signal. Accordingly, in case the decoded $CLD_m$ is greater than zero the channel signal m is assumed to be not channel transient with regard to the reference signal and is not postprocessed using the respective weighted time envelope (see step 511'). In case the decoded $CLD_m$ is smaller than zero the channel signal m is assumed to be channel transient with regard to the reference signal and postprocessed using the respective weighted time envelope (see step 513').

In an alternative embodiment, one of the channel signals is used as reference signal. The same method as described based on FIG. 16 can be used for postprocessing the multi-channel signals. In this case, only M−1 channel transient classification indications are required for deciding whether to postprocess the M channel signals. For the decision, whether to postprocess the reference channel signal or not, the same or a similar method as described for the stereo coding (based on FIGS. 5 and 8) can be used.

In another alternative embodiment, the overall downmix signal is formed by a number of downmix signals superior or equal to 1 and inferior to M. In that case, the reference signal can be one of the downmix signals and the downmix transient indication indicating whether the downmix signal is transient or not is associated with this downmix signal.

Referring to FIGS. 15, 14 and 17, the multi-channel audio encoding and decoding can be performed as follows.

First, at the encoder (see FIG. 15) the downmix signal is generated from the plurality M of channel signals $C_1$ to $C_M$, (corresponding to reference signs 315' and 317') forming the multi-channel signal, and used as input to the downmix encoder 307'. There is a transient detection model in the downmix encoder. If the downmix signal 319' is classified as downmix transient, a time envelope 323' of the downmix signal will be extracted by the downmix encoder 307' and transmitted to the decoder.

CLDs are extracted by the extractor 309' from the multi-channel signal by using the following equation.

$$CLD_m[b] = 10\log_{10}\frac{\sum_{k=k_b}^{k_{b+1}-1} X_{ref}[k]X_{ref}^*[k]}{\sum_{k=k_b}^{k_{b+1}-1} X_m[k]X_m^*[k]}, \tag{1}$$

wherein k is the index of frequency bin, b is the index of frequency band, $k_b$ is the start bin of band b, and $X_{ref}$ is the spectrum of the reference signal and $X_m$ are the spectrum of each channel of the multi-channel signal. The spectrum of the reference signal $X_{ref}$ can be either the spectrum of the downmix signal D 319' or the spectrum of one of the channel $X_m$ (for m in [1,M])

Channel transient also needs to be detected. This kind of detection is, for example, based on $CLD_m$ monitoring and performed by the detector 311'. If a fast change, also referred to as attack, of $CLD_m$ between two consecutive frames is detected, the channel m is classified as channel transient.

At the decoder (see FIG. 14) the multi-channel signal can be reconstructed by using the decoded downmix signal and the multi-channel parameters associated to the downmix signal.

If the received classification from the decoded downmix signal is downmix transient, embodiments of the invention use an additional processing module to improve the quality of the transient multi-channel signals.

Referring to FIG. 16, describing an embodiment of the decoding method performed by the decoder of FIG. 14, decoded $CLD_dq_m>0$ (see step 509') means the energy of the reference channel is bigger than the energy of channel under consideration m.

The weighting factor applied to the downmix time envelope of the downmix signal is calculated by the decider 211' in following way. The first step is to calculate the average of $CLD_m$ $$acld_m = \frac{1}{N}\sum_{b=0}^{b=N} CLD_m[b]. \tag{2}$$

The second step is to calculate c $$c = 10^{\frac{acld_m}{20}}. \tag{3}$$

In the last step, the weighting factor of channel m is calculated by $$a_m = \frac{2}{1+c} \tag{4}$$

Before applying the time envelope coming from the downmix decoding process to the channel m, this time envelope is first multiplied by the corresponding weighting factor $a_m$.

The determination, whether a channel m is channel transient, the calculation of the channel specific weighting factor $a_m$, the generation of the channel specific weighted time envelope based on the time envelope of the downmix signal and the channel specific weighting factor $a_m$, and the postprocessing of a channel signal based on the channel specific time envelope, as described for the multi-channel coding, can be performed for each channel or for only one or several of the plurality of channel signals and can be performed in parallel or serially.

Although, primarily embodiments have been described, wherein all of the M (or M−1 in case one channel signal is used as reference signal) channels of the multi-channel signal are channel transient classified, other embodiments of the encoder, the device and the decoder and the respective methods may be implemented that only a subset of the M channel signals is encoded and decoded, or channel classified and postprocessed. It should be noted that two channel signals of a multi-channel signal with M>2 channels may be processed like the left and right channel signal of a stereo signal, so that for these signals the embodiments for stereo processing, e.g. with stereo transient classification or channel transient classification, may be applied.

The invention claimed is:

1. A device for postprocessing at least one channel signal of a plurality of channel signals of a multi-channel signal, the at least one channel signal being generated from a decoded downmix signal by a low-bit-rate audio coding/decoding system, the device comprising:

a receiver for receiving the at least one channel signal generated from the decoded downmix signal, a time envelope of the decoded downmix signal and a classification indication indicating a transient type of the at least one channel signal, wherein the classification indication is associated to the at least one channel signal;

a postprocessor for postprocessing the at least one channel signal based on the time envelope of the decoded downmix signal weighted by a respective weighting factor and in dependence on the classification indication; and a decider for deciding which one or ones of the plurality of channel signals are postprocessed, the decider being configured to decide dependent on the classification indication indicating the transient type of the channel signal and on a further classification indication indicating a transient type of the downmix signal.

2. The device of claim 1, wherein the receiver is adapted to receive the plurality of channel signals and a plurality of classification indications, wherein each of the classification indications is associated to a channel signal of the plurality of channel signals, and wherein each of the classification indications indicates a transient type of the channel signal it is associated to, and wherein the device further comprises:

a decider adapted to decide which one or ones of the plurality of channel signals are postprocessed, wherein the decider is configured to decide dependent on the classification indication indicating the transient type of the respective channel signal.

3. The device of claim 1, wherein the decider is configured to control the postprocessor to postprocess the at least one channel signal in case the further classification indication indicates that the downmix signal is downmix transient and the channel specific classification indication associated to the at least one multi-channel signal indicates that the at least one channel is not channel transient.

4. The device of claim 1, wherein the decider is configured to control the postprocessor to postprocess the at least one channel signal in case the further classification indication indicates that the downmix signal is downmix transient, the channel specific classification indication associated to the at least one channel signal indicates that the at least one channel signal is channel transient, and an energy metric of the at least one channel signal is higher than a corresponding energy metric of a reference signal.

5. The device of one of the claim 1, wherein the decider is configured to control the postprocessor to postprocess the at least one channel signal in case the further classification indication indicates that the downmix signal is downmix transient, the channel specific classification indication associated to the at least one channel signal indicates that the at least one channel signal is channel transient, and a channel specific channel level difference $CLD_m$ between a reference signal and the at least one channel signal is smaller than a predetermined threshold.

6. The device of one of the claim 1, wherein the decider is configured to control the postprocessor to not postprocess the at least one channel signal in case the further classification indication indicates that the downmix signal is downmix transient, the channel specific classification indication associated to the at least one channel signal indicates that the at least one channel signal is channel transient, and an energy metric of the at least one channel signal is lower than a corresponding energy metric of a reference signal.

7. The device of one of the claim 1, wherein the decider is configured to control the postprocessor to not postprocess the at least one channel signal by using the weighted time envelope in case the further classification indication indicates that the downmix signal is downmix transient, the channel specific classification indication associated to the at least one channel signal indicates that the at least one channel signal is channel transient, and a channel specific channel level difference $CLD_m$ between the at least one channel signal and the at least one channel signal is greater than a predetermined threshold.

8. The device of one of the claim 1, wherein the decider is configured to determine the weighting factor, with which the time envelope of the downmix signal is to be weighted with for the postprocessing of the at least one channel signal, dependent on a received channel level difference (CLD) between the at least one channel signal and a reference signal.

9. The device of one of the claim 1, wherein the downmix signal forms a reference signal.

10. The device according to one of the claim 1, wherein the multi-channel signal is a stereo signal, the stereo signal comprising a first channel and a second channel.

11. A device for postprocessing at least one of a left and a right channel signals of a stereo signal, the left and right channel signals being generated from a decoded downmix signal by a low-bit-rate audio coding/decoding system, the device comprising:

a receiver for receiving the left channel signal and the right channel signal generated from the decoded downmix signal, a time envelope of the decoded downmix signal and a classification indication indicating a transient type of the stereo signal, a postprocessor for postprocessing at least one of the left and right channel signals based on the time envelope of the decoded downmix signal weighted by a respective weighting factor and in dependence on the classification indication; and a decider for deciding which one or ones of the left and right channel signals are postprocessed, said decider being configured to decide in dependence on the classification indication indicating a transient type of the stereo signal.

12. The device of claim 11, further comprising a decider for deciding which one or ones of the left and right channel signals are postprocessed, said decider being configured to decide in dependence on the classification indication indicating a transient type of the stereo signal and on a further classification indication indicating a transient type of the decoded downmix signal.

* * * * *